US009555456B2

(12) United States Patent
Rogers et al.

(10) Patent No.: US 9,555,456 B2
(45) Date of Patent: Jan. 31, 2017

(54) DYNAMIC CLAMP AND TOOL HOLDERS THEREFOR

(71) Applicant: Wilson Tool International Inc., White Bear Lake, MN (US)

(72) Inventors: Bryan L. Rogers, Forest Lake, MN (US); Brian J. Lee, Elk River, MN (US)

(73) Assignee: Wilson Tool International Inc., White Bear Lake, MN (US)

( * ) Notice: Subject to any disclaimer, the term of this patent is extended or adjusted under 35 U.S.C. 154(b) by 451 days.

(21) Appl. No.: 14/262,724

(22) Filed: Apr. 26, 2014

(65) Prior Publication Data

US 2015/0306651 A1 Oct. 29, 2015

(51) Int. Cl.

| | |
|---|---|
| ***B21D 37/14*** | (2006.01) |
| ***B21D 5/02*** | (2006.01) |
| ***B21D 37/06*** | (2006.01) |

(52) U.S. Cl.

CPC ..... *B21D 5/0245* (2013.01); *B21D 5/02* (2013.01); *B21D 5/0236* (2013.01); *B21D 37/06* (2013.01); *B21D 37/14* (2013.01)

(58) Field of Classification Search

CPC ..... B21D 5/02; B21D 37/06; B21D 37/14; B21D 5/0236; B21D 5/0245

USPC ..... 72/481.1, 482.1, 389.4, 389.6

See application file for complete search history.

(56) References Cited

U.S. PATENT DOCUMENTS

| | | | |
|---|---|---|---|
| 851,350 | A | 4/1907 | Frey |
| 4,315,425 | A | 2/1982 | Zbornik et al. |
| 4,534,203 | A | 8/1985 | Cros |
| 5,121,626 | A | 6/1992 | Baldwin |
| 5,390,527 | A | 2/1995 | Kawano |
| 5,511,407 | A | 4/1996 | Kawano |
| 5,513,514 | A | 5/1996 | Kawano |
| 5,572,902 | A | 11/1996 | Kawano |
| 5,619,885 | A | 4/1997 | Kawano et al. |
| 5,642,642 | A | 7/1997 | Kawano et al. |
| 5,685,191 | A | 11/1997 | Kawano et al. |
| 5,782,308 | A | 7/1998 | Latten et al. |
| 5,794,486 | A | 8/1998 | Sugimoto et al. |
| 6,138,492 | A | 10/2000 | Vining et al. |
| 6,151,951 | A | 11/2000 | Kawano |
| 6,446,485 | B1 | 9/2002 | Tarasconi |

(Continued)

FOREIGN PATENT DOCUMENTS

| | | |
|---|---|---|
| CN | 203236230 U | 10/2013 |
| DE | 3932629 A1 | 4/1990 |

(Continued)

OTHER PUBLICATIONS

International Search Report and the Written Opinion of Intl. Pat. App. No. PCT/US2015/027054 (corresponding to instant U.S. application), mailed Jul. 8, 2015, 11 pages, International Searching Authority, European Patent Office, Rijswijk, The Netherlands.

*Primary Examiner* — David B Jones
(74) *Attorney, Agent, or Firm* — Fredrikson & Byron P.A.

(57) ABSTRACT

A tool holder for locating and seating varieties of differing tools. The tool holder is usable with press brake tools as well as tools for other industrial machines and equipment. The tool holder includes a clamp and a supporting body. The clamp is an assembly and, via collective operation of its components, functions with the supporting body to locate and seat tools of a variety of differing styles, sizes, and geometries.

33 Claims, 22 Drawing Sheets

(56) References Cited

U.S. PATENT DOCUMENTS

| | | | | |
|---|---|---|---|---|
| 6,606,896 | B2 | 8/2003 | Tarasconi | |
| 6,644,090 | B2 | 11/2003 | Gasparini | |
| 7,069,766 | B2 | 7/2006 | Hayashi et al. | |
| 7,096,708 | B2 | 8/2006 | Gascoin | |
| 7,296,457 | B2 | 11/2007 | Morehead et al. | |
| 7,308,817 | B2 * | 12/2007 | Shimota ..... | B21D 5/0209 72/481.1 |
| 7,343,774 | B2 | 3/2008 | Gascoin et al. | |
| 7,721,586 | B2 | 5/2010 | Pabich et al. | |
| 8,496,255 | B2 | 7/2013 | Rouweler | |
| 2002/0023477 | A1 | 2/2002 | Gianelli | |
| 2005/0178183 | A1 | 8/2005 | Johnson et al. | |
| 2015/0306651 | A1 * | 10/2015 | Rogers ..... | B21D 5/0236 72/481.2 |

FOREIGN PATENT DOCUMENTS

| | | | |
|---|---|---|---|
| EP | 1449599 | A1 | 8/2004 |
| JP | H06-23436 | A | 2/1994 |
| WO | 0139906 | A1 | 6/2001 |
| WO | 2012145781 | A1 | 11/2012 |

* cited by examiner

Detail- C

DYNAMIC CLAMP AND TOOL HOLDERS THEREFOR

FIELD OF THE INVENTION

The present invention relates generally to tool holders for use with industrial machines or equipment. More particularly, this invention relates to mechanisms of such tool holders which enable tools to be located and seated on the holders.

BACKGROUND

Workpieces, such as sheet metal, can be fabricated into a wide range of useful products. The fabrication (i.e., manufacturing) processes commonly employed involve making various bends and/or forming holes in the workpieces. The equipment used for such processes involve many types, including turret presses and other industrial presses (such as single-station presses), Trumpf style machines and other rail type systems, press brakes, sheet feed systems, coil feed systems, and other types of fabrication equipment adapted for punching or pressing operations.

Concerning press brakes, they are equipped with a lower table and an upper table, and are commonly used for deforming workpieces. One of the tables (typically the upper table) is configured to be vertically movable toward the other table. Forming tools are mounted to the tables so that when one table is brought toward the other, a workpiece positioned there between can be bent into an appropriate shape. Typically, the upper table includes a male forming tool (a punch) having a bottom workpiece-deforming surface (such as a V-shaped surface), and the bottom table has an appropriately-shaped female tool (a die) having an upper surface vertically aligned with the workpiece-deforming surface of the male tool.

Continuing with press brakes, forming tools must be carefully mounted on a press brake in order to machine (e.g., bend) workpieces positioned there between to precise specifications. To that end, a forming tool has to be properly located and seated on the upper table (or lower table, as the case dictates) to enable such precise machining One conventional method for properly seating tools with press brake tables has involved loosely retaining a shank or tang of a tool in a holder coupled to one of the tables, and moving the table in a downward (or upward) direction until the tip of the tool abuts the other table. In such case, the tool can be correspondingly pushed against the load-delivering surface of the tool holder, and thereby seated in relation to the tool holder. In turn, the tool can be secured to the holder in such seated position. Unfortunately, while generally effective, this method has been found to be time-consuming. As such, more modern methods have involved using mechanisms with such holders to assist in locating and seating tools thereon. However, there remains room for improvement even with designs involving such mechanisms.

As is known, forming tools are generally defined with mounting and working portions. Typically, these portions are defined at opposing ends of the tools, with the mounting portion often involving a shank of the tool. In many cases, tool shanks are defined with a notch or groove therein for use in retaining the tool on a tool holder (wherein such holder is mounted to industrial machine or equipment, e.g., a table of a press brake). Such notches or grooves can be formed in a variety of shapes and sizes, and permit entry of a key of the tool holder therein such that the holder retains the tool prior to the tool being secured and thereby seated on the holder.

To that end, the engagement between key and notch/groove is also facilitated prior to the tool being removed from the holder. As such, the notch or groove provides a safety feature for the tool, whereby the tool would not release from its engagement with key of the tool holder without further act (e.g., rotation of the tool) by the operator. Regarding some tools, notches are defined therein to have squared-off edges. In such cases, an upper shoulder of such notch is often defined to be a set vertical distance from further tool surface intended to receive loading from the tool holder. This set distance is generally referred to as the tool's "notch distance." However, as described above, the shape of the notch can vary (e.g., so as to not to be entirely squared-off), and in such cases, the notch distance can be measured from the lowest point of contact of tool holder key within tool notch to the load-receiving surface of the tool.

Regarding such notch distances, they have generally become standardized in the industry. For example, some tool types have been designed to have notch distances measuring about 12.5 mm or about 13 mm; although notch distances are known to vary depending on the manufacturer of the tool and the design of industrial machine or equipment for which the tool is intended. Nevertheless, such standardization of notch distances presents difficulty if one attempts to use tools of differing manufacturers at random on industrial machines or equipment, such as a press brake. For example, the tools on hand may not conform to specifications of the press brake, and thus, would not be configurable with the tool holders mounted on the tables of such press brake. Although, even if tools were found able to be accommodated by such holders, there would be high potential that corresponding edges and surfaces of the tool and tables would be out of tolerance if the corresponding tool holders were not specifically designed for such tools. Thus, precise positioning mechanisms, for properly locating and seating tools of a variety of sizes and/or geometries, would be desirable for tool holders.

Embodiments of the present invention are intended to the address the above-described challenges (as well as others) with regard to tool holders, whether used with press brakes or other industrial machines and equipment.

SUMMARY OF THE INVENTION

In some embodiments, a clamp for a tool holder is provided. The clamp comprises a clamp body, one or more spring plates, a plurality of fingers, and a plurality of pins. The clamp body includes a first face and a second face opposing the first face. The clamp body is defined with a plurality of apertures spaced across a width of the clamp body. Each aperture extends from the first face to the second face. The one or more spring plates are operably coupled to the first face of the clamp body. Each spring plate has a plurality of legs each correspondingly extending within one of the apertures. The plurality of fingers is suspended from the second face of the clamp body. The fingers each include a fin protruding from an inner side and include a platform projecting from an outer side at a first end. Each fin correspondingly extends within one of the apertures and correspondingly contacts one of the legs of the one or more spring plates therein. Each platform is sized for engaging a notch or groove of a tool. The fingers define a slot at a second end. The plurality of pins each extends from the second face of the clamp body. The pins are correspondingly situated adjacent to one of the apertures. The pins correspondingly extend within the slots of the fingers. The fingers are each correspondingly pivotable and vertically displaceable about the pins relative to the clamp body.

In additional embodiments, a tool holder is provided. The tool holder comprises a clamp, a supporting body and an auxiliary block. The clamp comprises a clamp body, one or more spring plates, a plurality of fingers, and a plurality of pins. The clamp body includes a first face and a second face opposing the first face. The clamp body is defined with a plurality of apertures spaced across a width of the clamp body. Each aperture extends from the first face to the second face. The one or more spring plates are operably coupled to the first face of the clamp body. Each spring plate has a plurality of legs each correspondingly extending within one of the apertures. The plurality of fingers is suspended from the second face of the clamp body. The fingers each include a fin protruding from an inner side and include a platform projecting from an outer side at a first end. Each fin correspondingly extends within one of the apertures and correspondingly contacts one of the legs of the one or more spring plates therein. Each platform is sized for engaging a notch or groove of a tool. The fingers define a slot at a second end. The plurality of pins each extends from the second face of the clamp body. The pins are correspondingly situated adjacent to one of the apertures. The pins correspondingly extend within the slots of the fingers. The fingers are each correspondingly pivotable and vertically displaceable about the pins relative to the clamp body. The clamp is operably coupled yet pivotable relative to the supporting body, wherein the clamp and supporting body collectively define a tool channel adapted to locate and seat any of a plurality of differing tools. The auxiliary block is operably coupled to the supporting body and configured to assist in pivoting of the clamp.

In other embodiments, a tool holder is provided. The tool holder comprises a supporting body and a clamp. The supporting body has a load-delivering surface that is substantially perpendicular to a pressing axis of the tool holder. The clamp is operably coupled to the supporting body. The clamp and supporting body define a tool channel adapted to locate and seat any of a plurality of different tools. The clamp is selectively pivotable relative to the supporting body. A first pivotable configuration of the clamp corresponds to a clamping force being applied to a tool positioned within the channel and a second pivotable configuration of the clamp corresponds to a clamping force being released from a tool positioned within the tool channel. The clamp comprises one or more fingers adapted to engage tools inserted within the tool channel. The fingers are correspondingly suspended by one or more pins extending between the clamp and the supporting body. The fingers are both pivotable and vertically displaceable about the pins. The fingers are pivotable about the pins in the first pivotable configuration of the clamp for retaining a tool within the tool channel, and the fingers are vertically displaceable about the pins in the second pivotable configuration of the clamp for seating a load-receiving surface of the tool against the load-delivering surface of the supporting body.

In further embodiments, a method of locating and seating a tool on a tool holder is provided. The method comprises a step of providing a tool holder. The tool holder comprises a supporting body and a clamp operably coupled to the supporting body. The supporting body has a load-delivering surface that is substantially perpendicular to a pressing axis of the tool holder. The clamp and supporting body define a tool channel adapted to locate and seat any of a plurality of different tools. The clamp is selectively adjustable between first and second pivotable configurations relative to the supporting body. The method further comprises step of actuating the clamp to the second pivotable configuration. The clamp comprises fingers that are suspended by corresponding pins extending between the clamp and the supporting body. The fingers are biased inward toward the tool channel, wherein when the clamp is actuated to the second pivotable configuration, the fingers are deflectable outward from the tool channel to permit loading or removal of a tool from the channel. The method further comprises step of inserting a shank of a tool within the channel, resulting in initial pivoting of one or more of the fingers about the pins and subsequent retention of the tool shank within the channel via corresponding engagement of the one or more fingers with a notch of the tool shank. The method further comprises step of actuating the clamp to the first pivotable configuration, whereby the fingers are vertically displaced about the pins such that a load-receiving surface of the tool is seated against the load-delivering surface of the supporting body via the engagement between the one or more fingers with the tool notch.

BRIEF DESCRIPTION OF THE DRAWINGS

The following drawings are illustrative of particular embodiments of the present invention and therefore do not limit the scope of the invention. The drawings are not necessarily to scale (unless so stated) and are intended for use in conjunction with the explanations in the following detailed description. Embodiments of the invention will hereinafter be described in conjunction with the appended drawings, wherein like numerals denote like elements.

DETAILED DESCRIPTION

The following detailed description is exemplary in nature and is not intended to limit the scope, applicability, or configuration of the invention in any way. Rather, the following description provides some practical illustrations for implementing exemplary embodiments of the present invention. Examples of constructions, materials, dimensions, and manufacturing processes are provided for selected elements, and all other elements employ that which is known to those of ordinary skill in the field of the invention. Those skilled in the art will recognize that many of the noted examples have a variety of suitable alternatives.

Figure 1:
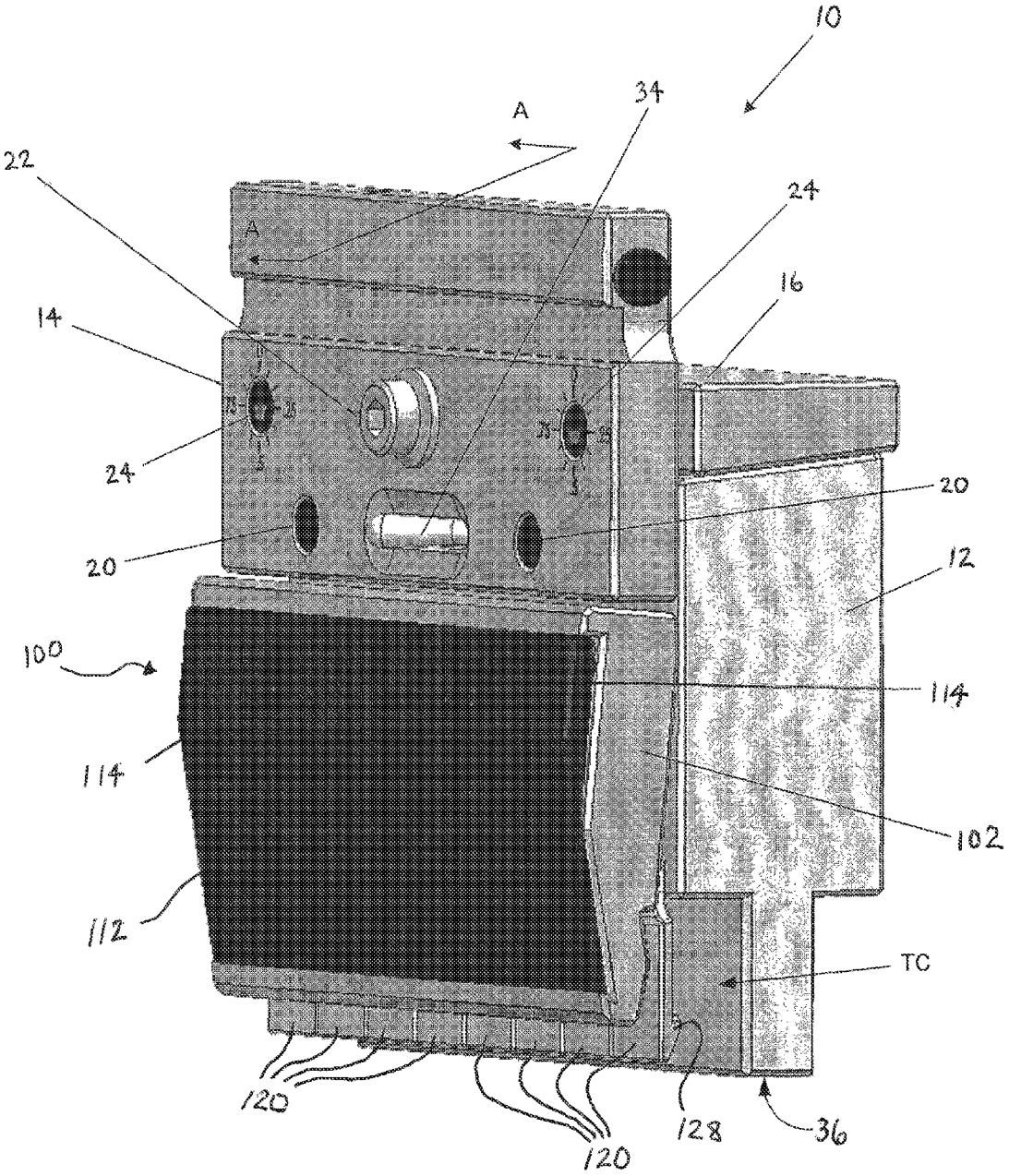
FIG. 1 is a perspective view of a tool holder in accordance with certain embodiments of the invention.

FIG. 1 shows a front perspective view of a tool holder 10 in accordance with certain embodiments of the invention, while FIGS. 2-5 show a variety of differing views of the holder 10. With reference to FIG. 1, in certain embodiments, the tool holder 10 includes a supporting body 12 and a clamp 100, and in further embodiments, the holder 10 additionally includes one or more of an auxiliary block 14 and a wedge member 16. As will be detailed herein, the clamp 100 is an assembly and, via collective operation of its components, is configured to function with the supporting body 12 to locate and seat tools of a variety of differing styles, sizes, and geometries. However, before focusing on this functioning, the components of the tool holder 10 are further described.

Figure 4:
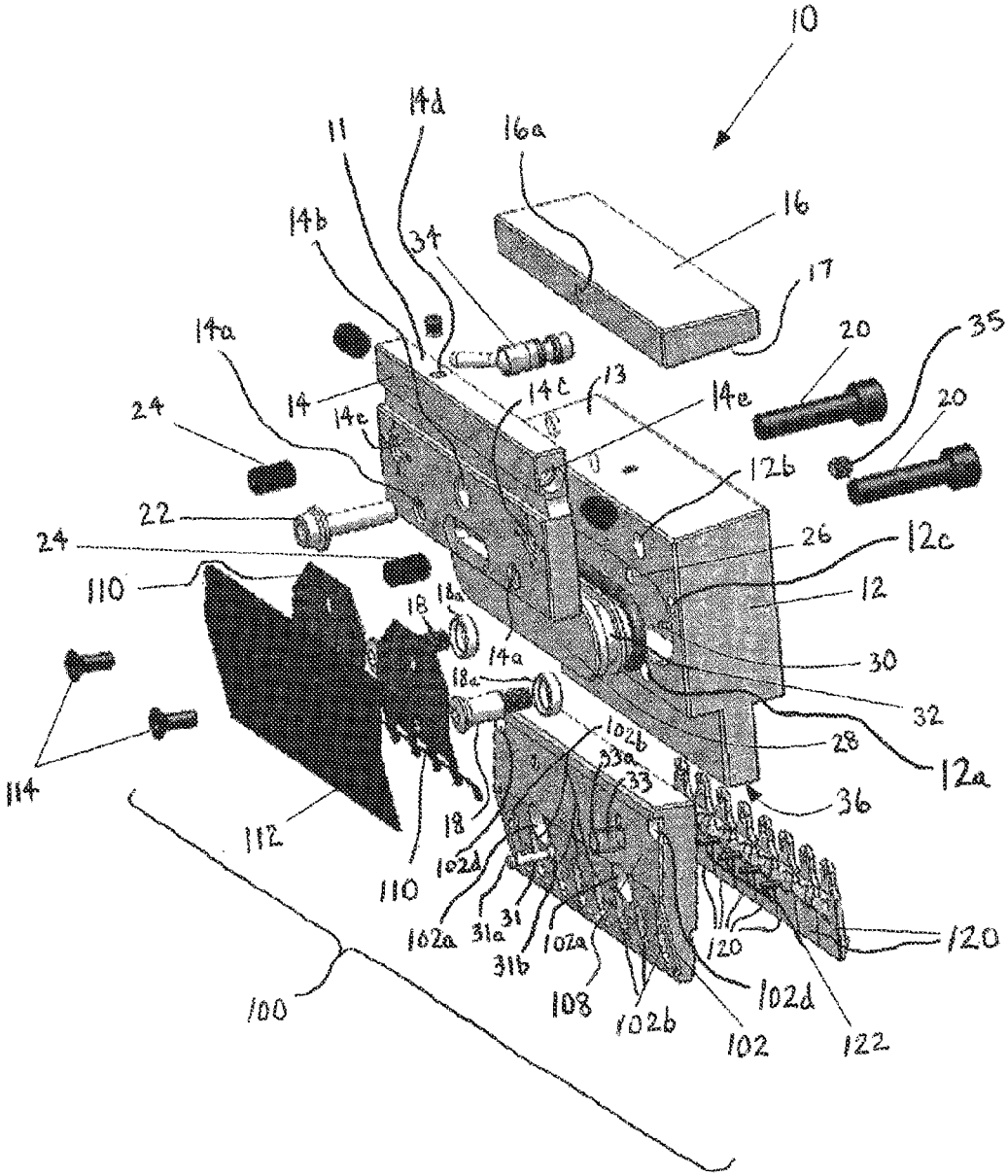
Figure 5:
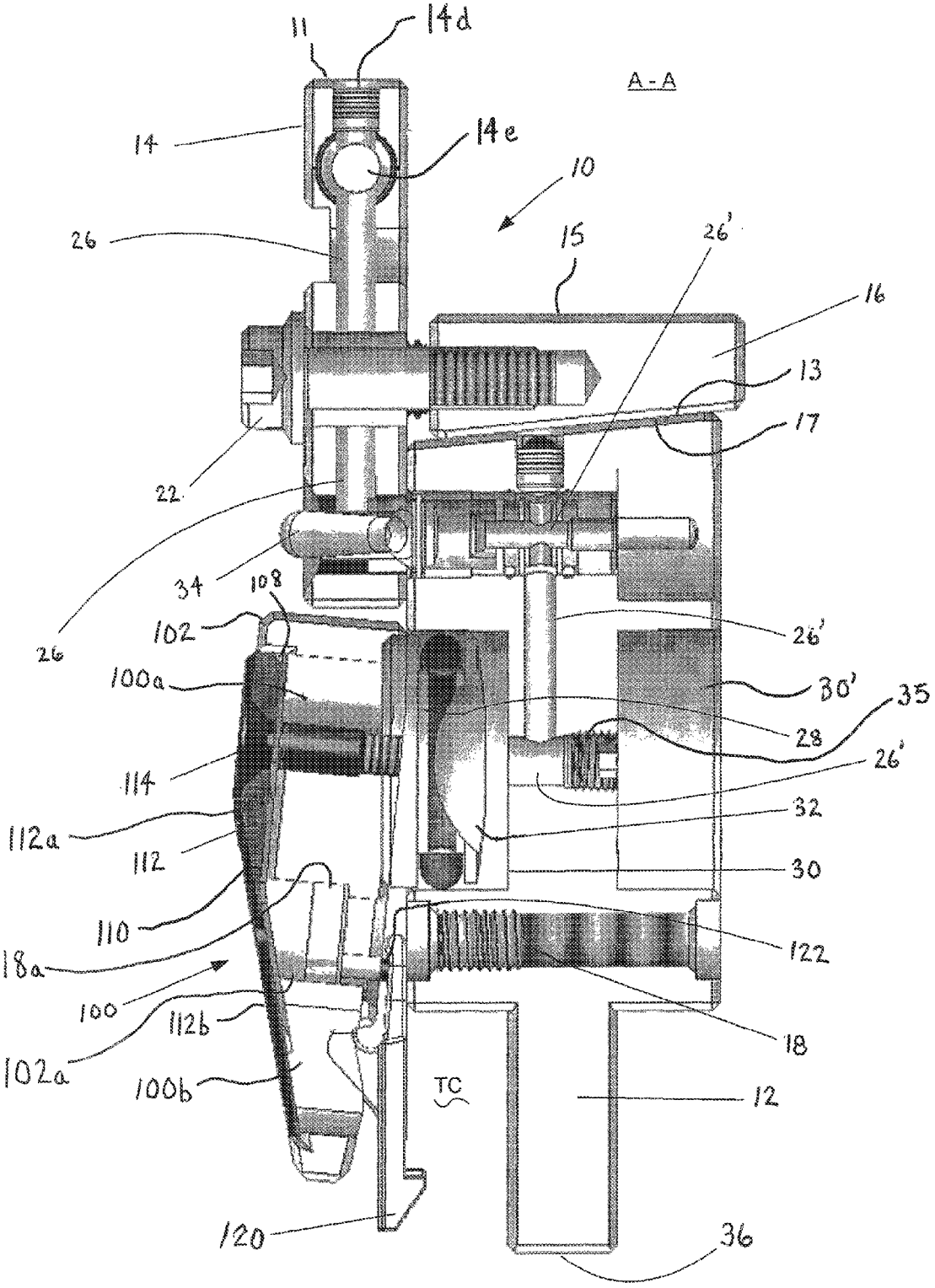
FIG. 5 is a cross-sectional view of the tool holder of FIG. 1 taken along dividing line A-A.

As alluded to above, the clamp 100 and supporting body 12 are the components of the tool holder 10 configured to directly engage tools (e.g., punches). To that end, the designs of the clamp 100 and the body 12 in some ways are interrelated. For example, and with reference to FIGS. 4 and 5 (illustrating exploded and cross-sectional views, respectively, of the tool holder 10), the clamp 100 is operably coupled to the supporting body 12 via a plurality of fasteners 18. With continued reference to FIG. 4, the fasteners 18 can extend within correspondingly-aligned well holes 102*a* of a body 102 of the clamp 100 and threaded holes 12*a* of the supporting body 12 (only one of the holes 12*a* is visibly shown). Turning to FIG. 5 and with continued reference to FIG. 4, the fasteners 18 enable mounting of the clamp 100 to the supporting body 12, yet the clamp 100 is also enabled to pivot about such fasteners 18. For example, in certain embodiments as shown, pivot washers 18*a* are correspondingly inserted within the clamp body well holes 102*a*. To that end, the fasteners 18 extend through the pivot washers 18*a*, whereby the heads of such fasteners 18 engage such washers 18*a*. In certain embodiments, the fasteners 18 are pivot bolts, whereby the clamp 100 pivots relative to inclined undersides of the heads of such bolts, with the pivot washers 18*a* preventing incidence of binding between the fasteners 18 and the clamp 100 when pivoted. As will be further detailed herein, the clamp 100 is enabled to pivot so as to apply or release a clamping force on a tool 200 inserted in a tool channel TC defined between the clamp 100 and supporting body 12 (see FIGS. 18 and 19).

As described above and turning back to FIGS. 1 and 2 (with FIG. 2 showing a side view of the tool holder 10), in certain embodiments, the tool holder 10 includes the auxiliary block 14. The auxiliary block 14, in certain embodiments, is operably coupled to the supporting body 12, e.g., via fasteners 20. With reference to FIG. 4, the fasteners 20 (e.g., through-bolts with threaded ends) can extend within correspondingly-aligned through-holes 12*b* of the supporting body 12 (only one of the holes 12*b* is visibly shown) and threaded bores 14*a* of the auxiliary block 14. When coupled in such manner, the auxiliary block 14 can be positioned adjacent to the clamp 100, yet with space there between so as to not interfere with the clamp 100 when pivoted.

The auxiliary block 14 can serve many functions. For example, in press brake applications, the block 14 can assist in stabilizing the assembly of the tool holder 10 to one of the tables of the press brake. For such function, in certain embodiments, the wedge member 16 is further added to the tool holder 10. While certain configurations (e.g., sizes, shapes, etc.) of the auxiliary block 14 and wedge member 16 are described and illustrated herein, it should be understood that such block 14 and member 16 can be varied as needed to make the tool holder adaptable to differing varieties of industrial machines or equipment. In the exemplified case, and with reference to FIG. 2, an upper inner surface 15 of the wedge member 16 can be brought in contact with, and operably coupled to, a surface of a press brake table, e.g., via use of fasteners. Looking to FIG. 5, the wedge member 16 is shown as being operably coupled (and, as necessary, selectively moveable relative) to the mounting body 14 via use of fastener 22. Turning to FIG. 4, the fastener 22 (e.g., a through-bolt having threaded end) can extend within correspondingly-aligned through-hole 14*b* of the auxiliary block 14 and bore 16*a* of the wedge member 16.

With reference back to FIG. 5, the wedge member 16 is positioned so as to contact the supporting body 12. In certain embodiments, as shown, the contacting surfaces of the member 16 and the body 12 (i.e., the underside 17 of the member 16 and upper surface 13 of the body 12, respectively) are defined with opposing slopes, such that the surfaces correspondingly mate. To that end, and over the course of machining with the tool holder 10, if the vertical position of the supporting body 12 (and the clamp 100 coupled thereto) were to loosen, e.g., shifting downward from its intended vertical setting, such could be corrected via rotation of the fastener 22. Particularly, via rotation of the fastener 22, the wedge member 16 is correspondingly moved toward or away from the auxiliary block 14 (as needed) so as to reestablish intended engagement with the supporting body 12, thereby compensating for variations in height of the body 12 and returning the tool holder assembly to a more stable configuration.

Figure 2:
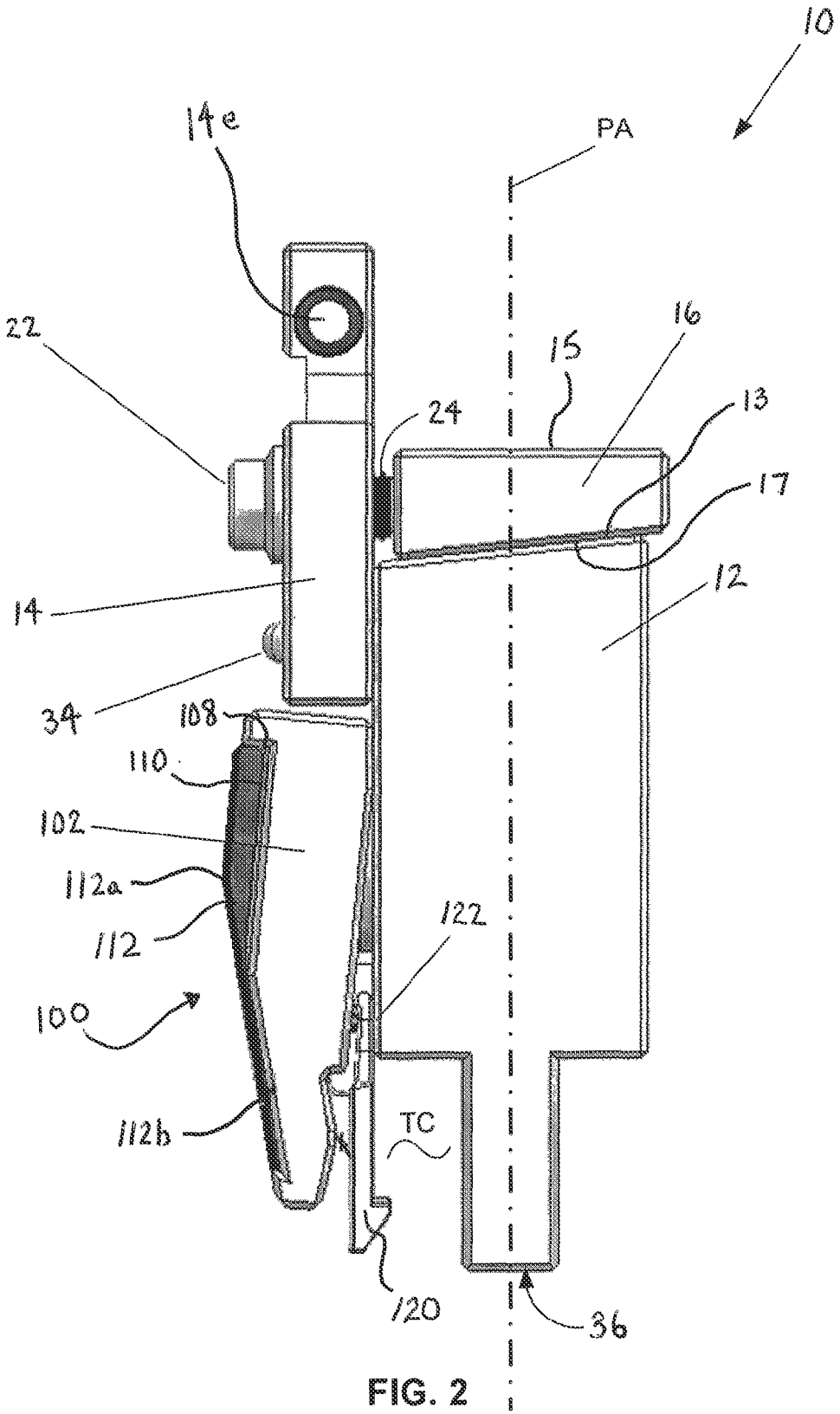
FIGS. 2-4 are side, front, and exploded views of the tool holder of FIG. 1.
Figure 3:
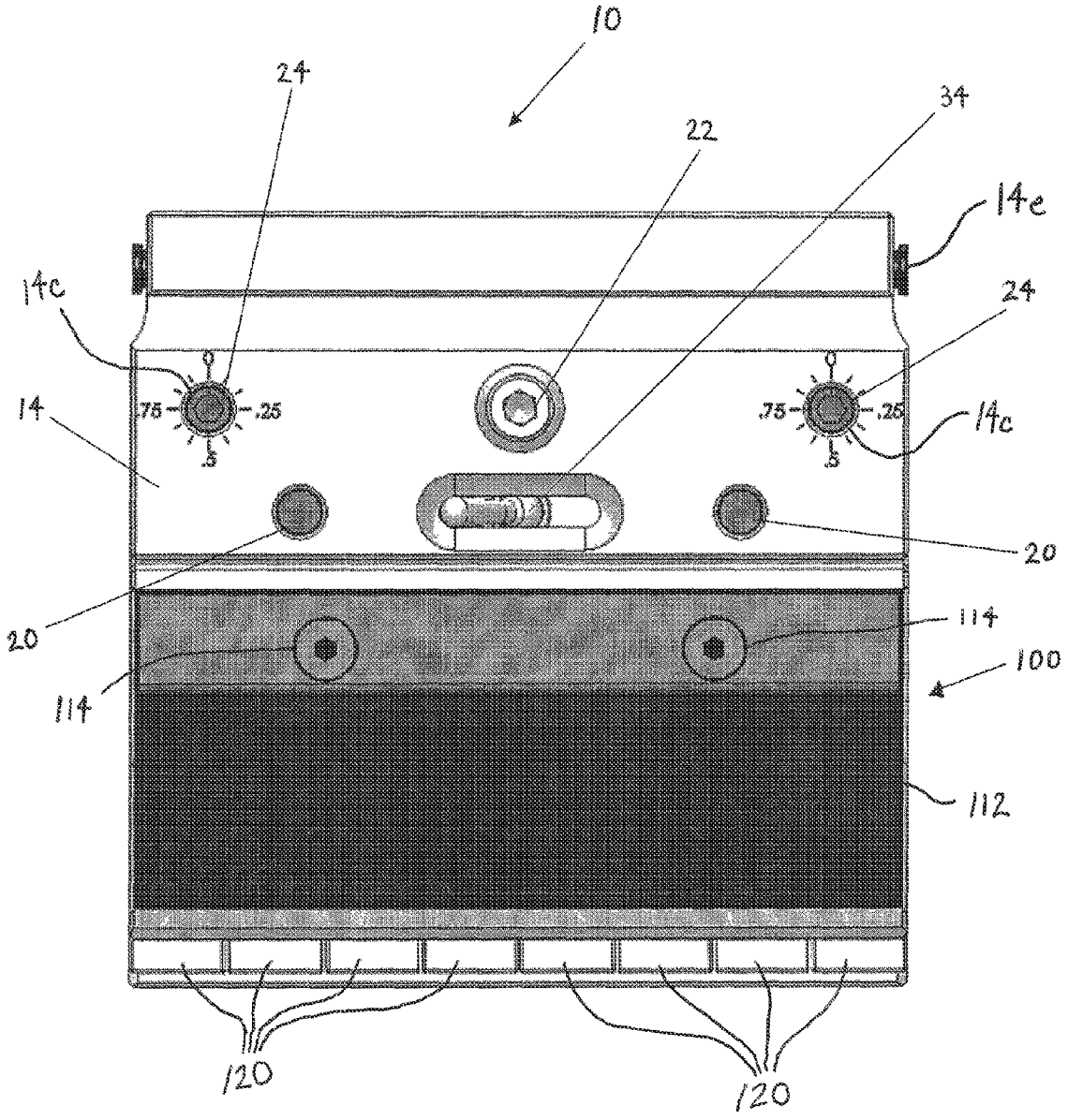

Continuing with the above, in certain embodiments with reference to FIGS. 2-4 (with FIG. 3 showing a front view of the tool holder 10), fasteners 24 (e.g., threaded inserts) are provided in threaded holes 14*c* of the auxiliary block 14, so as to align with (and in use, contact) the wedge member 16. The amount of rotation of such fasteners 24 (such that leading ends of the fasteners 24 contact the wedge member 16) can indicate the amount of vertical shift of the supporting body 12 over time (e.g., measured via parameters imprinted around the threaded holes 14*c* of the auxiliary block 14, perhaps most clearly shown in FIG. 3). Further, contact between the fasteners 24 and wedge member 16 prevents the member 16 from unintentionally creeping along the fastener 22 (coupling the member 16 and auxiliary block 14) toward the auxiliary block 14.

A further function of the auxiliary block 14, in certain embodiments as shown by FIG. 5, is to assist with the above-described pivoting of the clamp 100. To that end, in certain embodiments, the tool holder 10 includes an integrated system which serves to selectively actuate (e.g., pivot) the clamp 100, as desired. In certain embodiments, such system is based on fluid power. For example, with continued reference to FIG. 5, a pneumatic system can be used, whereby the auxiliary block 14 and supporting body 12 serve as thoroughfares (with channels 26 and 26' respectively defined therein) for flow of air through the system. In certain embodiments, such system is configured to actuate a piston 28. As shown, the piston 28 can be mounted within a recessed portion 30 of the supporting body 12 so as to fit between the supporting body 12 and the clamp 100. With further reference to FIG. 5, the piston 28 can translate within the recessed portion 30, whereby when the piston 28 moves outward from the supporting body 12, an end portion 100*a* of the clamp 100 which overlays the piston 28 is correspondingly moved outward.

Continuing with pneumatic system, in certain embodiments as shown in FIG. 5, a pocket 32 can be connected to an outlet of such channels 26' of the supporting body 12 and positioned to underlie the piston 28. In such case, when the system is activated, air is permitted to flow into the channels 26, 26', such that the pocket 32 correspondingly takes on such air and expands outward from the body 12 toward the clamp end portion 100*a*. The piston 28, as a result of the expanding pocket 32, is forced outward from the recessed portion 30, correspondingly pushing clamp end portion 100*a* outward. The clamp 100 in turn pivots about the fasteners 18, whereby the opposing end portion 100*b* of the clamp 100 is moved toward the supporting body 12 (see FIG. 18), and can resultantly provide a clamping force on a tool within tool channel TC. Conversely, when the system is deactivated, the flow of air is halted within the channels 26' of the supporting body 12, whereby the outward force on the piston 28 via the pocket 32 correspondingly discontinues. As such, the piston 28 is correspondingly enabled to retract inward. In certain embodiments, such retraction of the piston 28 results from further operable coupling of the clamp 100 and supporting body 12, as described below. To that end, via such coupling, the clamp 100 is forced to pivot back about the fasteners 18, whereby the end 100*b* of the clamp 100 moves away from the supporting body 12 (see FIG. 19) such that a tool can be removed from the tool channel TC.

As alluded to above and with reference to FIG. 4, the clamp 100 and supporting body 12 can be further coupled via fasteners 31 and corresponding spring members 33. Such coupling not only aids in pushing the piston 28 back inward toward the supporting body 12 as necessary (as noted above), but also dictates extent by which the overlaying clamp end portion 100*a* can be pushed outward (and corresponding degree by which the clamp 100 can pivot about the fasteners 18). The spring members 33 are sized so as to be accommodated within corresponding well holes 102*d* of the clamp body 102. In certain embodiments as shown, the fasteners 31 are rods having outer and inner heads 31*a* and 31*b* on opposing ends thereof. To that end, and with reference to FIGS. 4 and 14, the fasteners 31 can each be positioned so as to correspondingly extend through the spring members 33, protrude outward from the bores 102*d*, and extend into correspondingly-aligned key holes 12*c* of the supporting body 12 (only one of the key holes 12*c* is visibly shown in FIG. 4).

Continuing with the above, the inner heads 31*b* of the fasteners 31 are slid (and thereby retained) within the key holes 12*c*, while the outer heads 31*a* of the fasteners 31 are situated within the well holes 102*d* yet outside the corresponding spring members 33. In certain embodiments, the outer heads 31*a* of the fasteners 31 have outer diameter that exceeds outer diameter of outer ends 33*a* of the spring members 33. Accordingly, when the piston 28 is forced outward from the recessed portion 30 (thereby, pushing the clamp end portion 100*a* outward), the outer heads 31*a* of the fasteners 31 are correspondingly pulled within the well holes 102*d*, whereby the spring members 33 are compressed between the heads 31*a* and inner lips 102*e* of said holes 102*d* (see FIG. 12). Conversely, when flow of air is halted from entering the pocket 32 such that no outward force is applied on the piston 28, the spring members 33 correspondingly recoil so as to push the fastener heads 31*a* outward from the inner lips 102*e* of the well holes 102*d*. As should be appreciated, such expansion of the spring members 33 correspondingly forces the clamp end portion 100*a* to be moved inward toward the supporting body 12, thereby pushing piston 28 back to its retracted position against the pocket 32.

While embodiments described herein involve a pneumatic system for actuating the clamp 100, the invention should not be limited to such. For example, the system could just as well employ hydraulics, whereby flow of fluid would be employed to pivot the clamp 100. In combination with such systems, electrical and/or mechanical means could serve to control the fluid power from the system, and correspondingly trigger application of the above-described clamping force via pivoting of the clamp 100. For example, in certain embodiments as shown in FIGS. 1-5 (and which will be further described herein), a manual switch 34 is used to control (i.e., open or close) communication between the channels 26 of the auxiliary block 14 and the channels 26' of the supporting body 12. Thus, in a closed position of the switch 34, the flow (e.g., of air or fluid) to the channels 26' of the supporting body 12 is stopped, whereby the clamp 100 correspondingly pivots back toward the supporting body 12, as described above. In certain embodiments, the switch 34 can be a single-pole, single-throw ("on-off") switch, and can involve any of a variety of styles. For example, while illustrated as a toggle switch, the switch 34 could alternately be a push-button switch or an electric switch. To that end, as will be later described herein, such switch 34 can be actuated either manually or electronically, e.g., via remotely-transmitted signal. Contrary to the above, it should be further appreciated that the system for pivoting the clamp 100 could be manually-based, as opposed to using flow of air or fluid for triggering purposes. For example, in some cases, a handle and corresponding cam (as opposed to fluid power and piston) can be employed to pivot the clamp 100 as desired.

Figure 6:
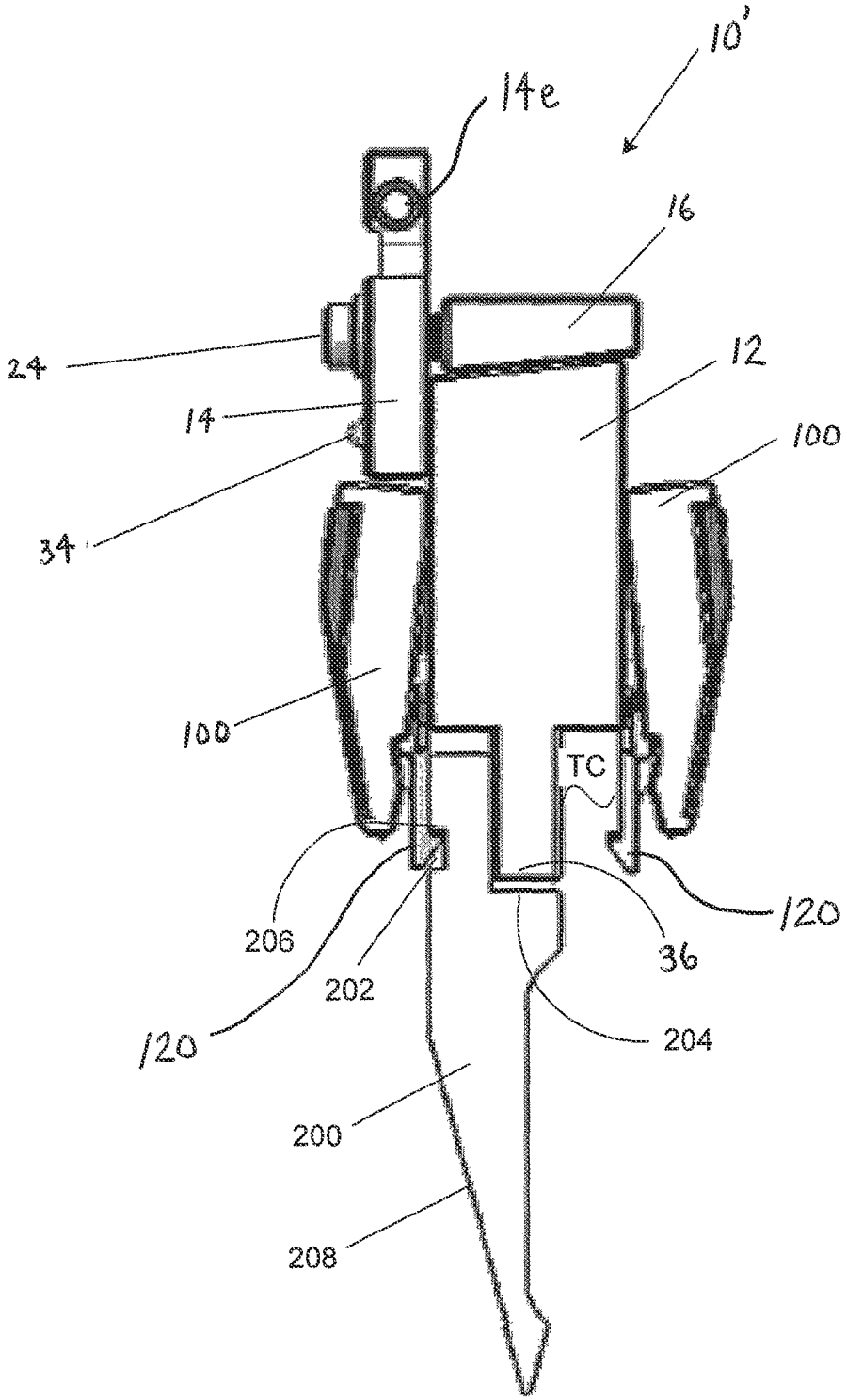
FIG. 6 is a side view of further tool holder in accordance with certain embodiments of the invention.

FIG. 6 shows a further tool holder 10' with similar features to the tool holder 10 of FIGS. 1-5. As should be appreciated, a primary difference between the two holders 10, 10' is that the tool holder 10' includes a pair of clamps 100, each mounted on opposing vertical surfaces of the supporting body 12 of the holder 10'. As such, the holder 10' can accommodate a tool with either of the clamps 100 (and in some cases, while not shown, can accommodate multiple tools 200 with simultaneous use of both clamps 100). Turning back to FIG. 5, in certain embodiments, the supporting body 12 is defined with further recessed portion 30' in opposing side of the supporting body 12 so as to accommodate piston assembly for further clamp 100 (as shown in FIG. 6). To that end, the channels 26, 26' can be equally shared in pivoting both clamps 100. Alternately, as shown in FIG. 5, a stopper 35 (e.g., screw) can be used to plug the channel 26' leading to such further recessed portion 30' if a further clamp 100 (and further piston assembly) is not used with the tool holder.

Figure 20:
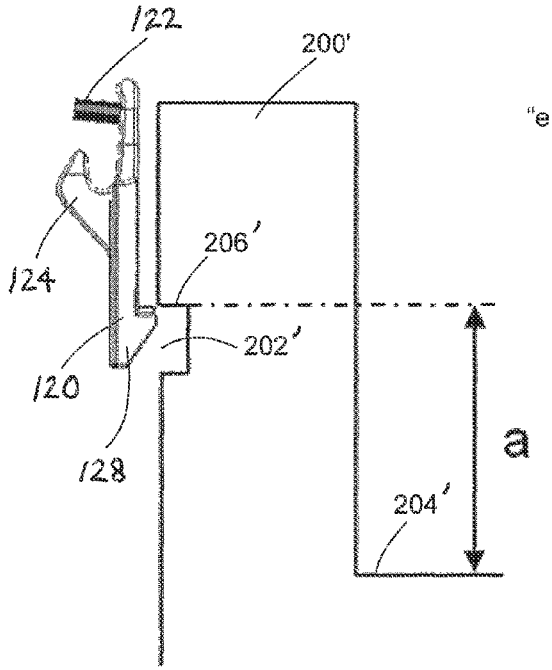
FIGS. 20 and 21 are enlarged cross-sectional views of finger and pin of clamp of FIG. 7 with reference to tools having different notch distances in accordance with certain embodiments of the invention.
Figure 21:
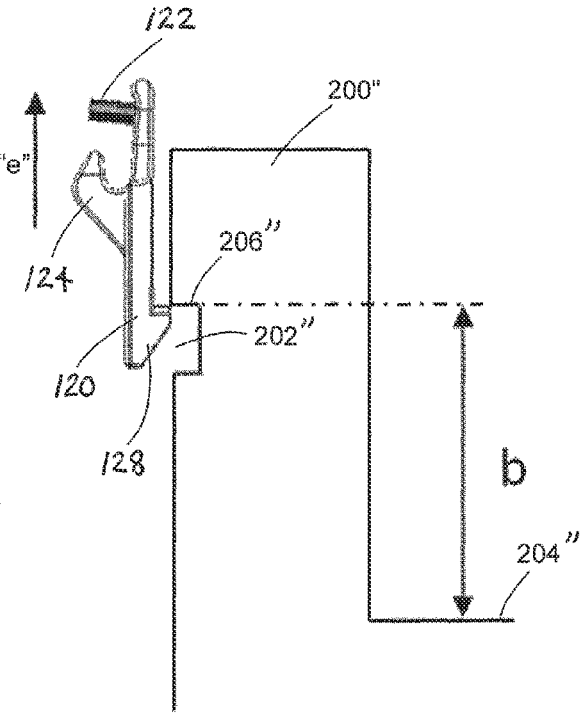

Regarding the illustrated, yet exemplary, tool 200, among its features (the significance of which is later detailed herein) is a notch 202 defined in the tool's shank to facilitate retention of the tool 200 between the clamp 100 and the supporting body 12. The tool 200 further includes a load-receiving surface 204 which, when the tool 200 is located in the tool channel TC, can be subsequently seated against the supporting body 12 and its load-delivering surface 36. As already noted herein, in the case of tools having notches with squared-off surfaces, such as shown in exemplary tool 200 of FIG. 6, an upper shoulder 206 of the notch 202 is typically defined to be vertically offset from the load-receiving surface 204 by a set distance, or "notch distance." Such notch design can be of differing sizes. For example, FIGS. 20 and 21 show shanks of tools 200' and 200," each defined with differing sizes of notches 202' and 202", respectively. Given such differing notch sizes, the tools 200', 200" have corresponding different notch distances "a" and "b". Further, as described above, tools can be found to have differing notch shapes (e.g., not having squared-off surfaces). In such cases, the notch distance can be measured from the lowest point of contact of tool holder key within tool notch to the load-receiving surface of the tool. Of course, such differing notch shapes (e.g., defined with one or more ramped or angled surfaces) can also be of differing sizes, similar to what is depicted in FIGS. 20 and 21.

Given the above, it should be appreciated that tools are known to have notches or grooves of a variety of differing sizes and shapes. However, despite this variability, notch distances of tools have generally become standardized in the industry. For example, some tool types have been designed to have notch distances measuring about 12.5 mm or about 13 mm; although notch distances can vary from these distances depending on the manufacturer of the tool and the design of industrial machine or equipment for which the tool is intended. To that end, the tool holders embodied herein are configured to locate and seat various tool types having wide range of notch distances.

Figure 7:
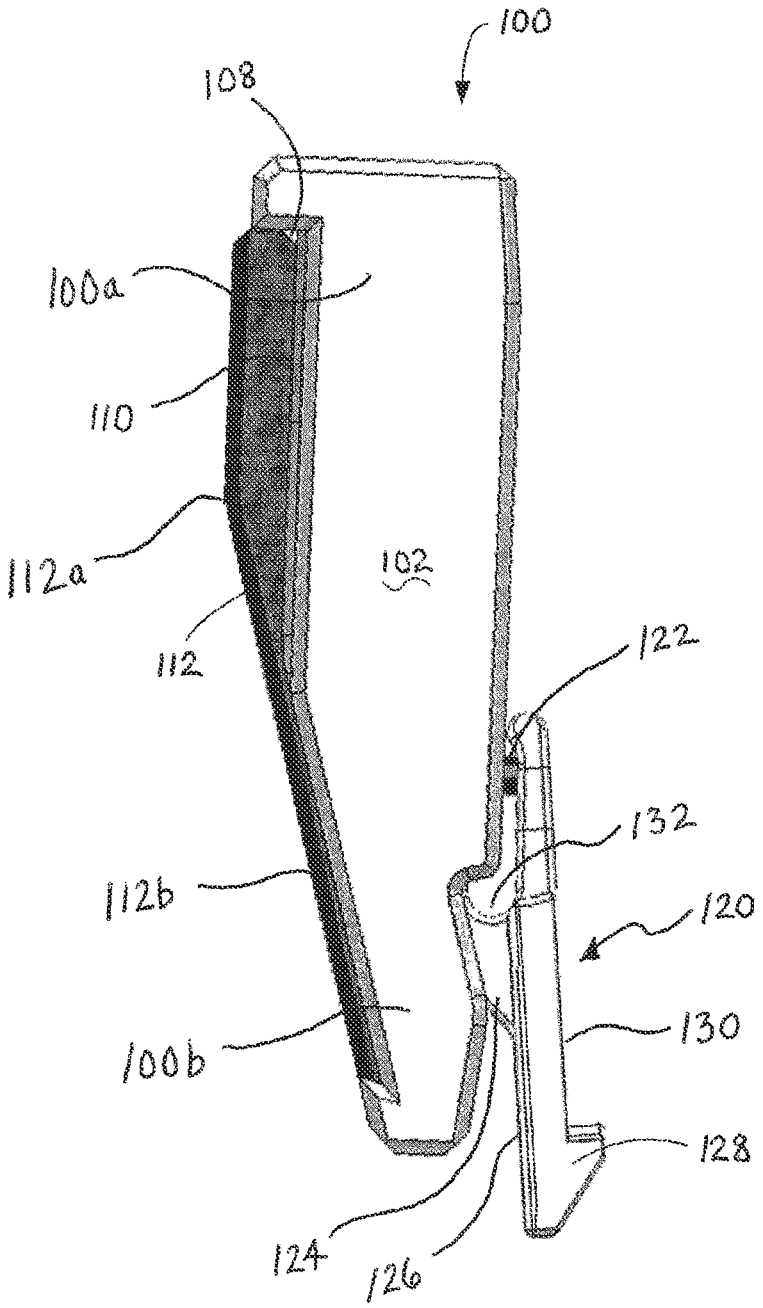
FIG. 7 is a side view of a clamp of the tool holder of FIG. 1 in accordance with certain embodiments of the invention.

Turning to FIG. 7, the clamp 100 of the tool holder 10 of FIGS. 1-5 (and of the tool holder 10' of FIG. 6) is illustrated. The components of such clamp 100, while also shown in FIG. 4, are perhaps better appreciated with reference to FIG. 8, which shows an enlarged exploded view of the clamp 100. As shown, in certain embodiments, the clamp 100 includes a clamp body 102 defined with apertures 102*b* extending from outer face 104 to opposing inner face 106 of the body 102. While the apertures 102*b* are shown as being a plurality of apertures 102*b* spaced along a width of the body 102, it should be appreciated that the clamp body 102 could also function with single aperture 102*b* extending along a given width of the clamp body 102. The clamp 100 further includes one or more spring plates 110 situated on the clamp's outer face 104. With continued reference to FIG. 8, the clamp 100 is shown as including two spring plates 110 positioned side-to-side; however, the invention should not be limited to such. For example, the width dimension of the spring plate 110 is variable, such that any quantity of spring plates 110 (e.g., one spring plate 110, or two or more spring plates 110 aligned in side-by-side fashion) can be situated on the clamp's outer face 104. One benefit of designing the spring plate 110 to have a curtailed width is that the plate 110 (or multiples thereof) can be readily used with clamps of varying widths.

Figure 8:
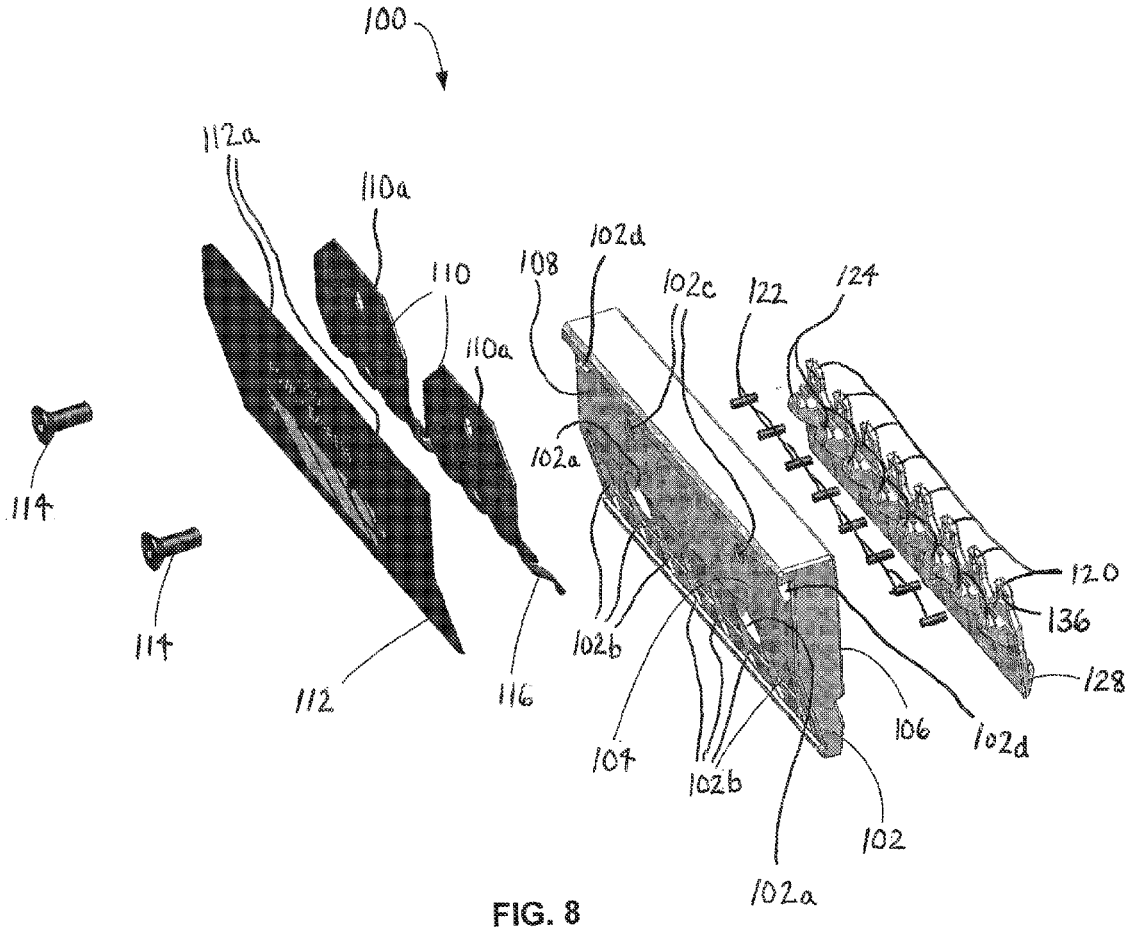
FIG. 8 is an exploded view of the clamp of FIG. 7.
Figure 12:
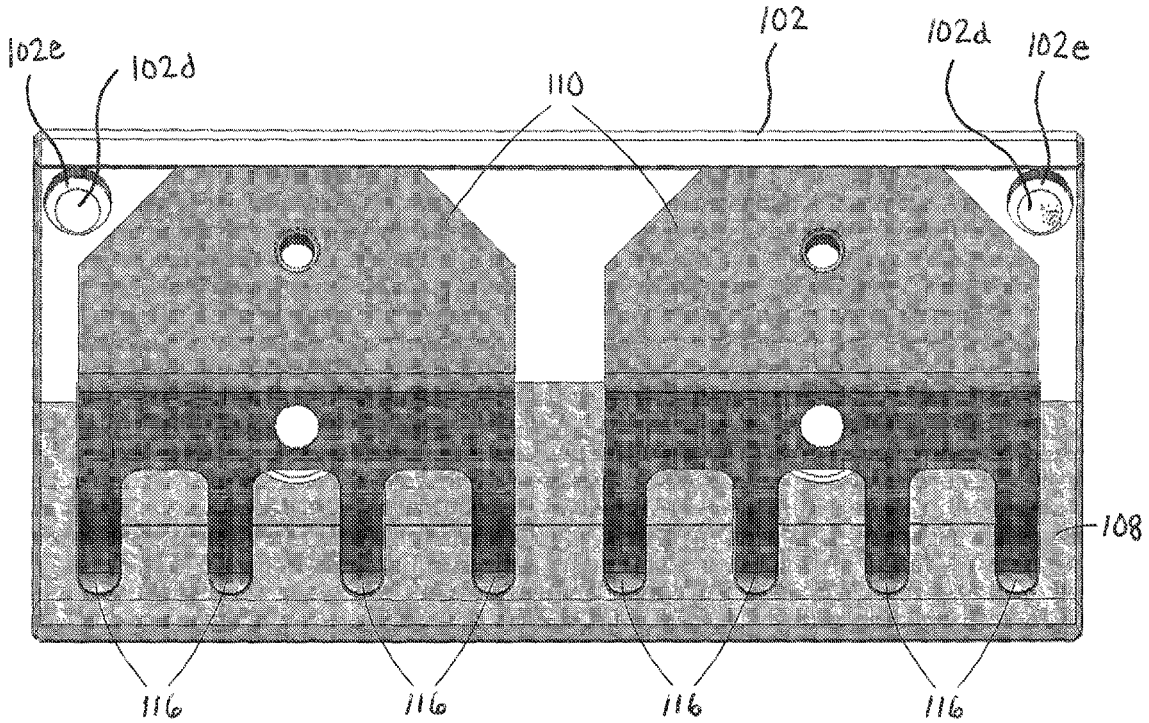
Figure 15:
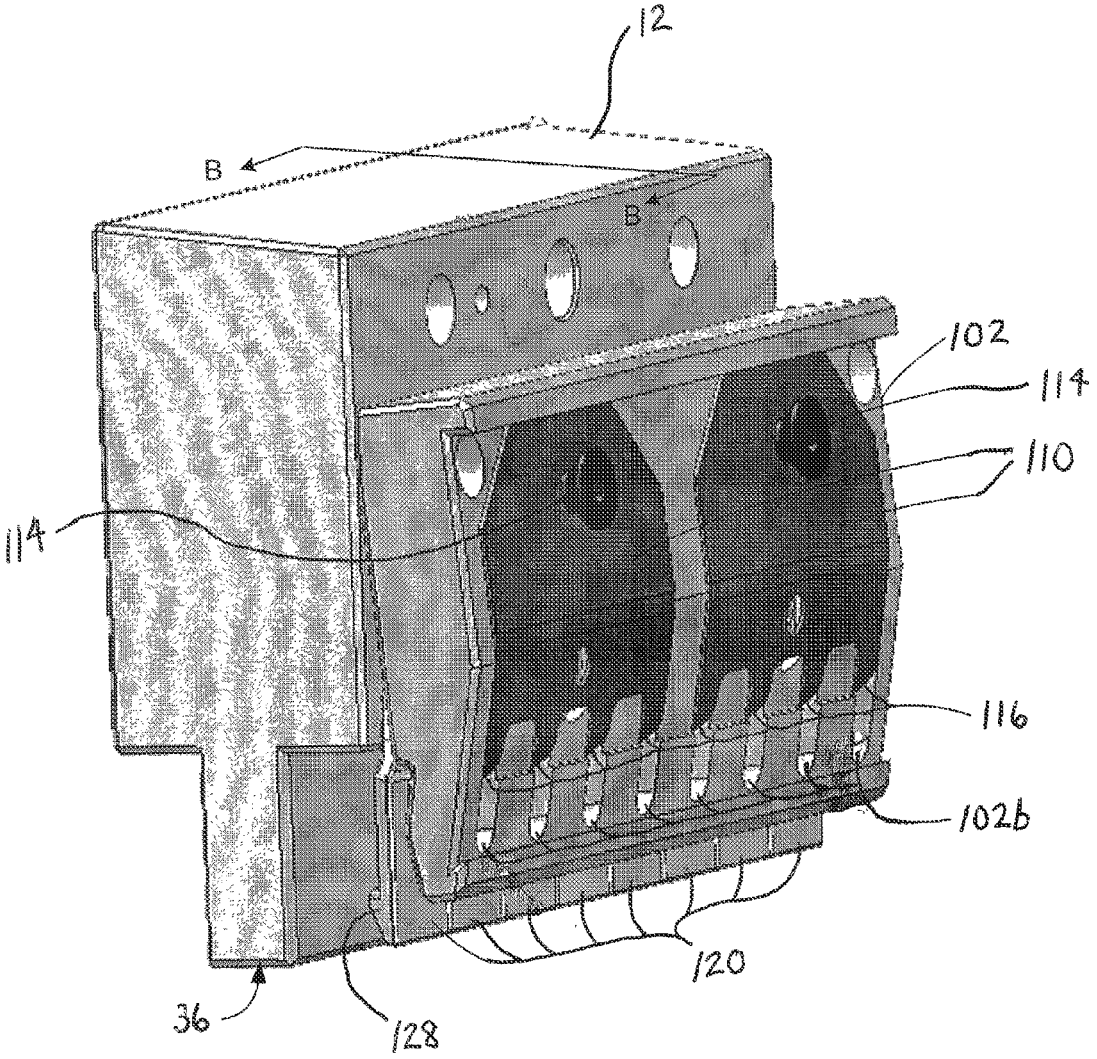
FIG. 15 is a side perspective view of further selected portions of the tool holder of FIG. 1.

In certain embodiments, the clamp body 102 defines a recess 108 within its outer face 104. To that end, in certain embodiments, each spring plate 110 can be held within such clamp body recess 108, so as to be encapsulated between the clamp body 102 and a cover plate 112 operably coupled (e.g., via fasteners 114) to the body 102. With further reference to FIG. 8, each fastener 114 (e.g., screw) can extend within correspondingly-aligned through-hole 112*a* of the cover plate 112, hole 110*a* of a spring plate 110, and threaded bore 102*c* of the clamp body 102. In certain embodiments, as shown in FIG. 7, the cover plate 112 is configured to be at least substantially received within the recess 108 of the clamp body 102, while the spring plate 110 is entirely received within such recess 108. For perhaps more clear depictions, FIG. 12 shows a front view of the outer face 104 of the clamp body 102 with two spring plates 110 positioned in the body's recess 108, while FIG. 15 illustrates a side perspective view of the clamp 100 (without cover plate 112) as assembled to the supporting body 12, wherein the fasteners 114 are shown coupling the two spring plates 110 to the clamp body 102.

Figure 10:
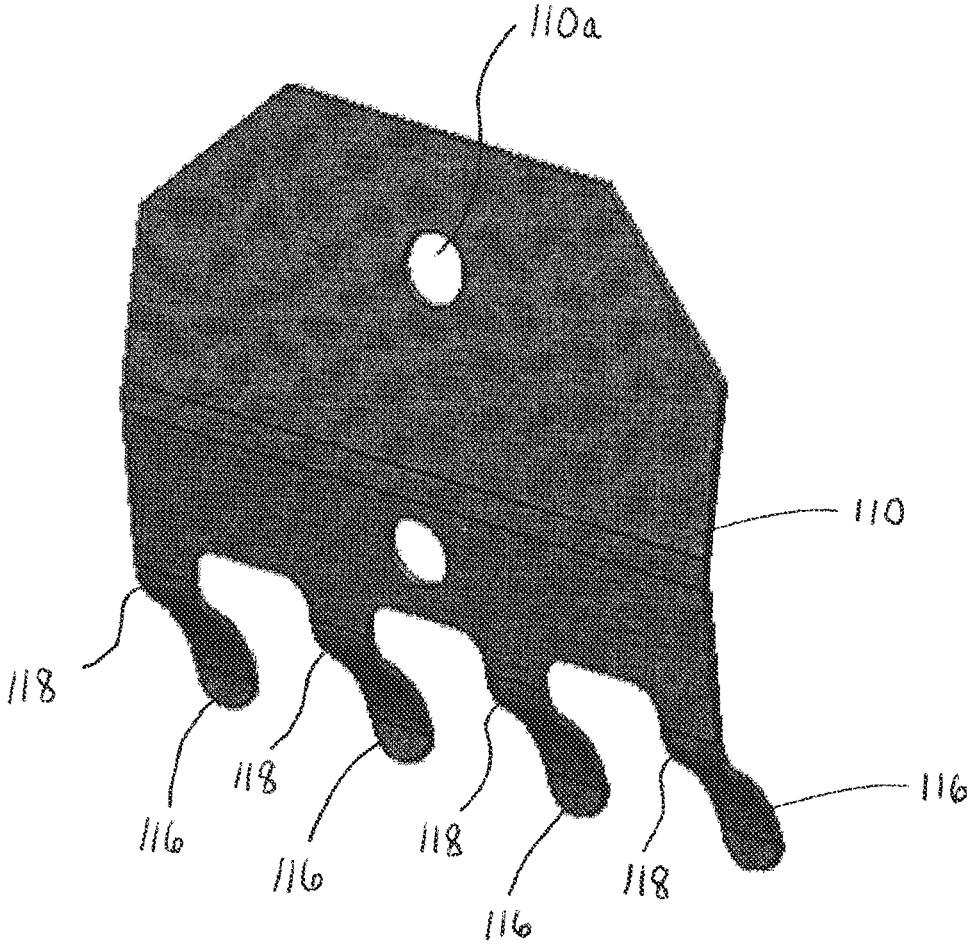
FIG. 10 is a perspective view of a spring plate of the clamp of FIG. 7.

An enlarged view of the spring plate 110 is illustrated in FIG. 10. The plate 110, in certain embodiments, is formed of a material which exhibits certain rigidity despite the thinness of the plate 110. For example, the spring plate 110 can be formed of steel. Alternately, in certain embodiments, the plate 110 can be formed of a plastic or shape memory alloy that when actuated, e.g., by electrical current or heat, can exhibit a change in orientation relative to the apertures 102*b* of the clamp body 102. In certain embodiments, as shown, the spring plate 110 is defined with a plurality of segments or legs 116. With reference to FIG. 15, in certain embodiments, each of the legs 116 is configured so as to align with a corresponding one of the apertures 102*b* of the clamp body 102, with each leg 116 having similar bend 118 therein so as to extend within said apertures 102*b*. Thus, when the clamp 100 is assembled, not only is the spring plate 110 encapsulated, but each leg 116 thereof is resiliently biased to project within one of the apertures 102*b* of the clamp body 102. As should be appreciated, while the spring plate 110 is shown to have a plurality of legs 116, whereby each leg 116 is configured to correspond to one of the clamp body apertures 102*b*, the spring plate 110 would also function if the clamp body 102 is defined with only a single aperture 102*b* with elongated width. In such embodiments, the spring plate 110 can still include a plurality of legs 116 with each extending into the aperture 102*b* in spaced-apart manner; however, it should be appreciated that by having separate apertures 102*b* for each leg 116, the potential of the legs 116 laterally shifting over time (so as to depart from their defined spacing) can be minimized. Alternately, the spring plate 110 in such embodiments can be configured to have a single leg 116 with elongated width extending into single aperture 102*b*. Although, some advantages of configuring the spring plate 110 to have a plurality of legs 116 (as opposed to a single leg 116) is that such configuration is capable of deflecting in part, e.g., via force being applied on one or more of the legs 116, and more easily adapted to deflect as a whole, e.g., via the spaced orientation of the legs 116.

As noted above, the clamp 100, along with the supporting body 12, is configured to directly engage tools. As described above and will be further detailed herein, the clamp 100 enables various tool types to be located and seated on the tool holder 10. However, in certain embodiments, the clamp's design further enhances the functionality of the holder 10 with such tools. Looking back to FIG. 7 and with further reference to FIGS. 2 and 5, the profile of clamp body 102 narrows as it extends toward the end portion 100*b* of the clamp 100. Likewise, the cover plate 112 has an inward bend 112*a* so as to correspond to the narrowing profile of the clamp body 102. As described above, in certain embodiments, the clamp's profile is narrowed even further with definition of the recess 108 in the clamp body's outer face 104, such that the cover plate 112 is at least substantially received, and the spring plate(s) 110 are encapsulated, within the recess 108. The significance of encapsulating the spring plate(s) 110 in such manner will be further appreciated from later description herein. However, by the profile of the cover plate 112 narrowing in line with the clamp body 102 (and in some embodiments, in which at least portion 112*b* or the entirety of the cover plate 112 is held within the clamp body recess 108), the tool holder 10 is enabled to have narrowed relationship with the holder's pressing axis PA (see FIG. 2), and thus an enhanced bend clearance for machining operations when using the tool holder 10.

Figure 19:
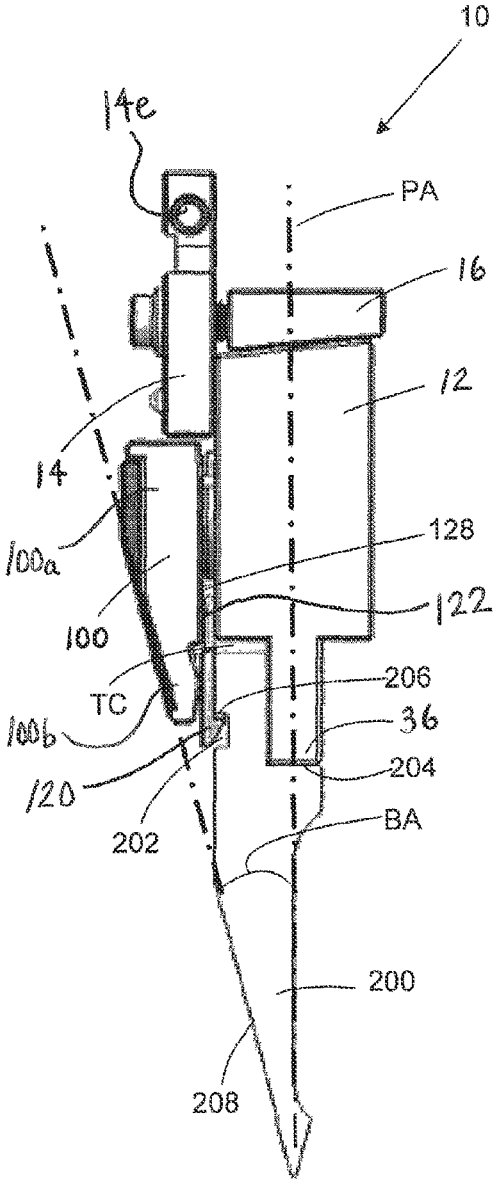

For example, with reference to FIG. 19 (showing side view of tool 200 located and seated on the tool holder 10), bend clearance angle BA is the angle defined between the holder's pressing axis PA and the widest portion of the tool holder 10. Generally, conventional tool holder designs, particularly those including clamps, have a clearance angle much wider than clearance angle of tool body (defined between the holder's pressing axis PA and the widest portion 208 of the tool 200). However, with the narrowed profile of the clamp 100, the bending clearance angle BA of the tool holder 10 is minimized so as to be close to or within the clearance angle of the tool. In certain embodiments, the bend clearance angle BA achieved with the holder 10 is no greater than 15°. To that end, tools used with the tool holder 10 have wide clearance during bending operations, with such clearance being maintained throughout the machining stroke of a press table. This is not the case for other known tool holders, as such a narrowed bend clearance angle can only be maintained for a partial extent of a table's stroke, i.e., until the profile of the tool holder may interfere with the sheet metal or workpieces being machined.

Figure 11:
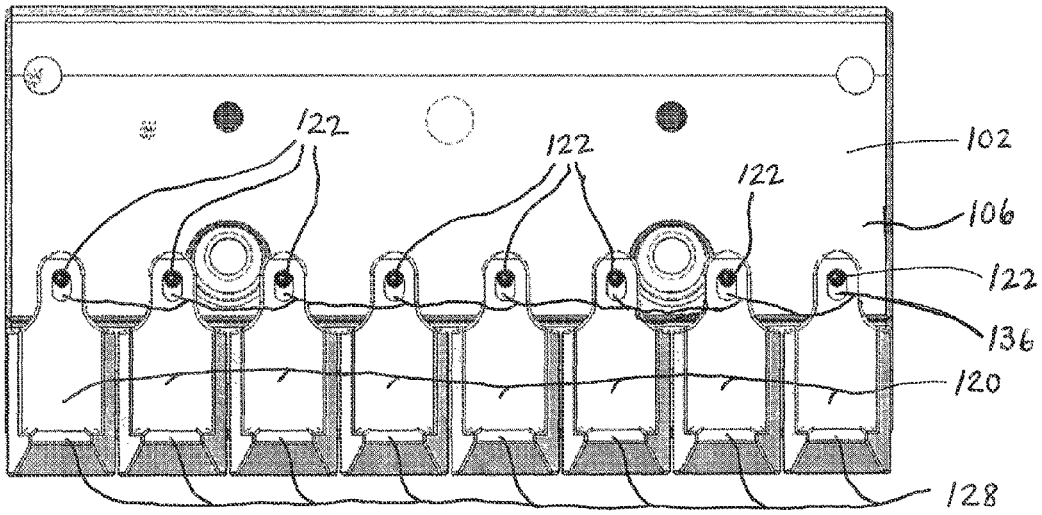
FIGS. 11 and 12 are front views of inner and outer faces, respectively, of the clamp of FIG. 7.
Figure 13:
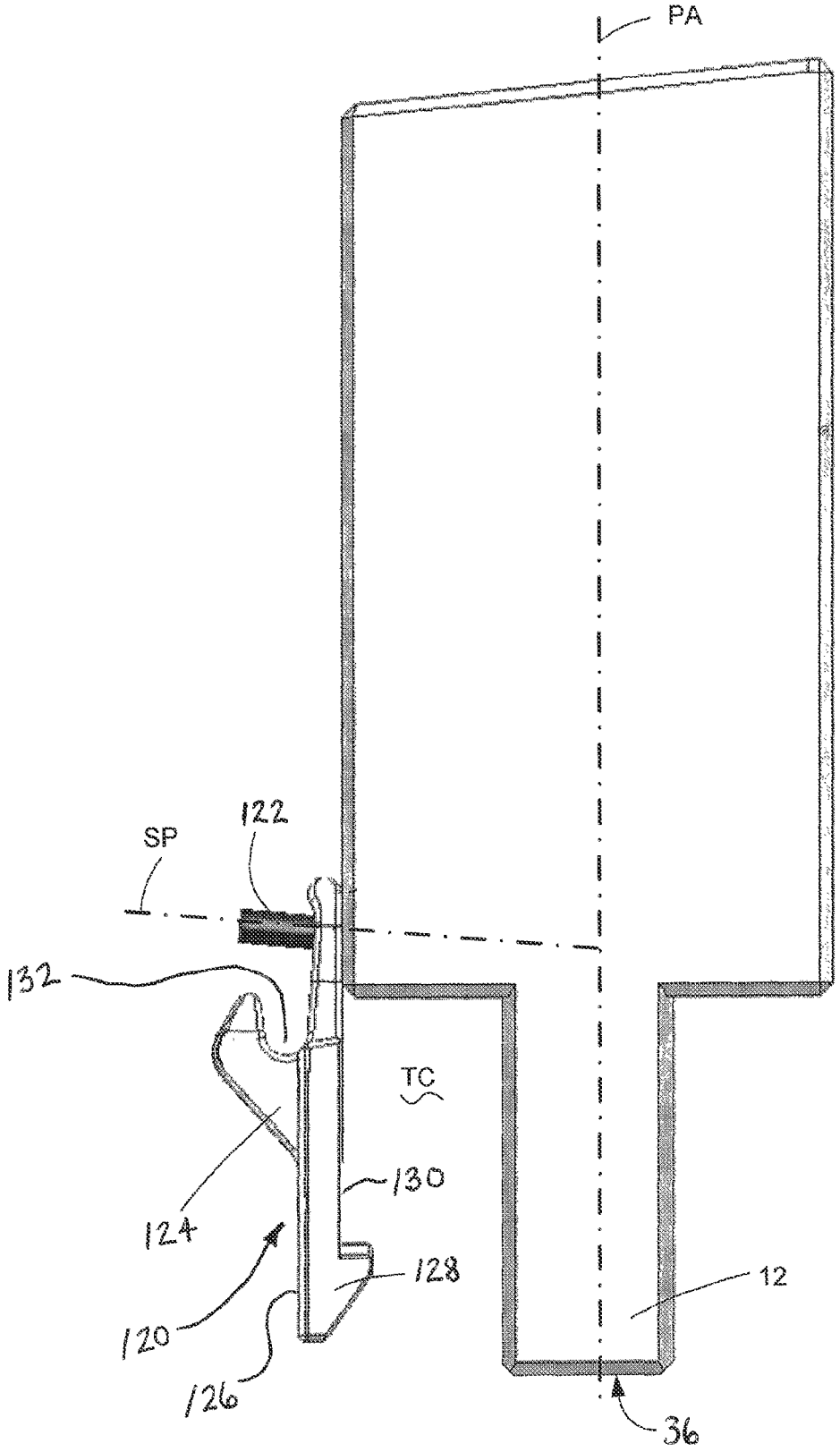
FIGS. 13 and 14 are side and front views of selected portions of the tool holder of FIG. 1.

Turning back to FIGS. 7 and 8, and with reference to FIG. 11 (showing a front view of the inner face of the clamp 100), the clamp 100, in certain embodiments, is shown as including a plurality of elements or fingers 120. As will be further detailed below, each finger 120 is coupled to the body 102 of the clamp 100 in suspended fashion via a pin 122, enabling the fingers 120 freedom both to be pivoted and be vertically displaced, as is necessary to accommodate differing tool sizes yet without over travel of the finger 120. As shown in FIG. 7, each finger 120 includes a member or fin 124 protruding from an inner face 126 thereof (relative to the clamp body 102), and a further member or platform 128 projecting from an outer face 130 thereof. In certain embodiments and as perhaps most clearly shown in FIG. 13 (which shows a side view of a finger 120 relative to the supporting body 12), the fin 124 of each finger 120 curves along its extent, forming a hook and defining a pocket 132 between the fin 124 and the finger inner face 126. To that end and with reference to FIG. 8, the apertures 102*b* of the clamp plate 102 are spaced apart so as to accept a corresponding plurality of fingers 120 (an enlarged view of such plurality of fingers 120 being illustrated in FIG. 9). Particularly, and with reference to FIGS. 16 and 17 (showing cross sectional and enlarged detail views, respectively, of the clamp 100 coupled to the supporting body 12), the fins 124 of the fingers 120 are configured to extend within and hook around shoulders 134 defined within the corresponding apertures 102*b*.

While not shown, it should be appreciated that the fingers 120 can still function given modifications made to other elements of the clamp 100 already described. For example, if the apertures 102*b* are instead replaced with a single aperture 102*b* with elongated width, the fins 124 of such fingers 120 can each extend into the aperture 102*b* in spaced-apart manner. Alternately, the fingers 120 in such embodiments can be configured to be joined in side-to-side manner and thus have a single fin 124 with elongated width extending into the single aperture 102*b*. Although, some advantages of configuring the fingers 120 to be separate from each other (thereby forming a plurality of fingers 120 and corresponding fins 124) is that such configuration is capable of deflecting in part, e.g., via force being applied on one or more of the fingers 120, and more easily adapted to deflect as a whole, e.g., via the spaced orientation of the fingers 120.

Figure 16:
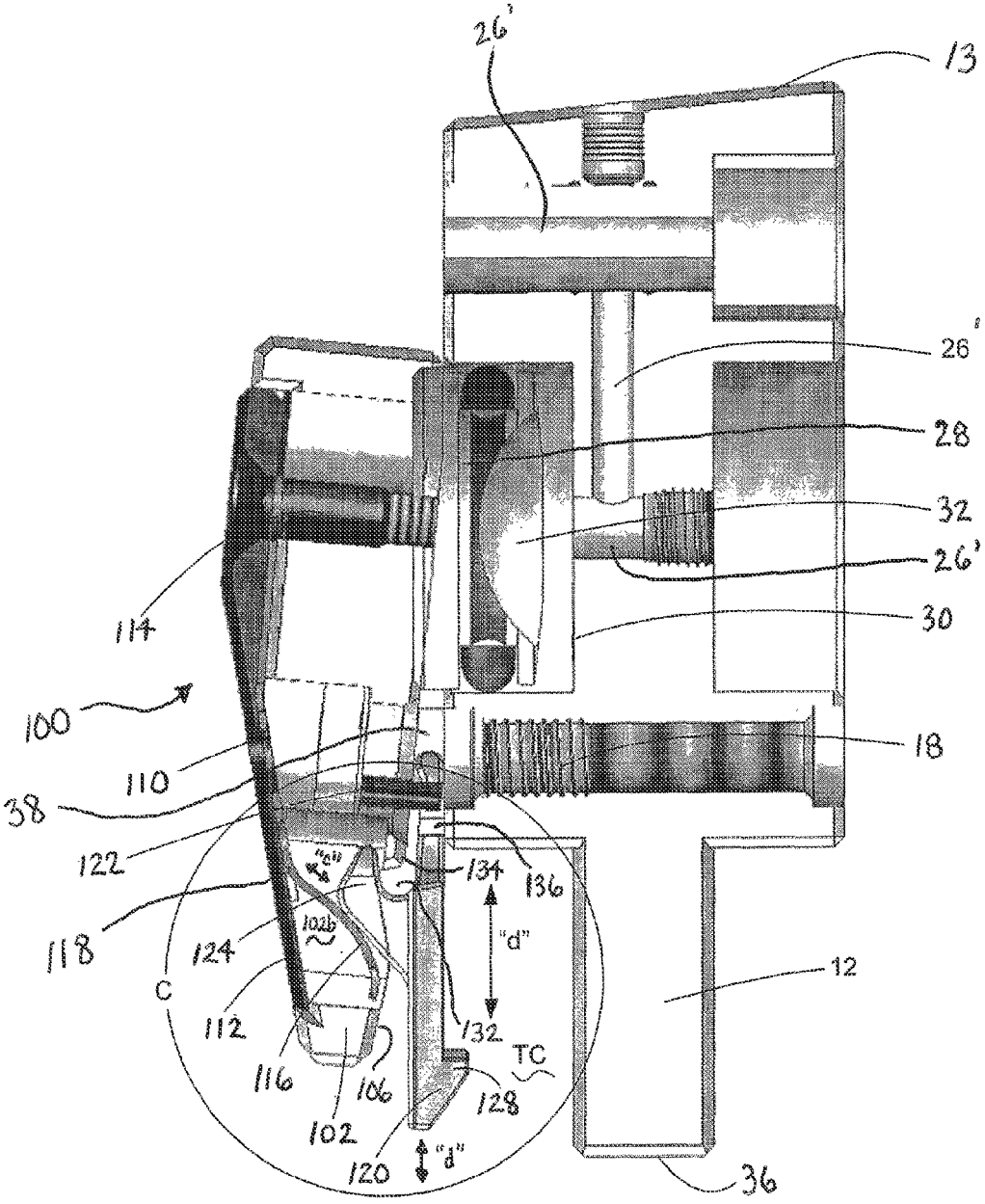
FIG. 16 is a cross-sectional view of the selected tool holder portions of FIG. 15 taken along dividing line B-B, but with cover plate further included and coupled to outer face of clamp.
Figure 17:
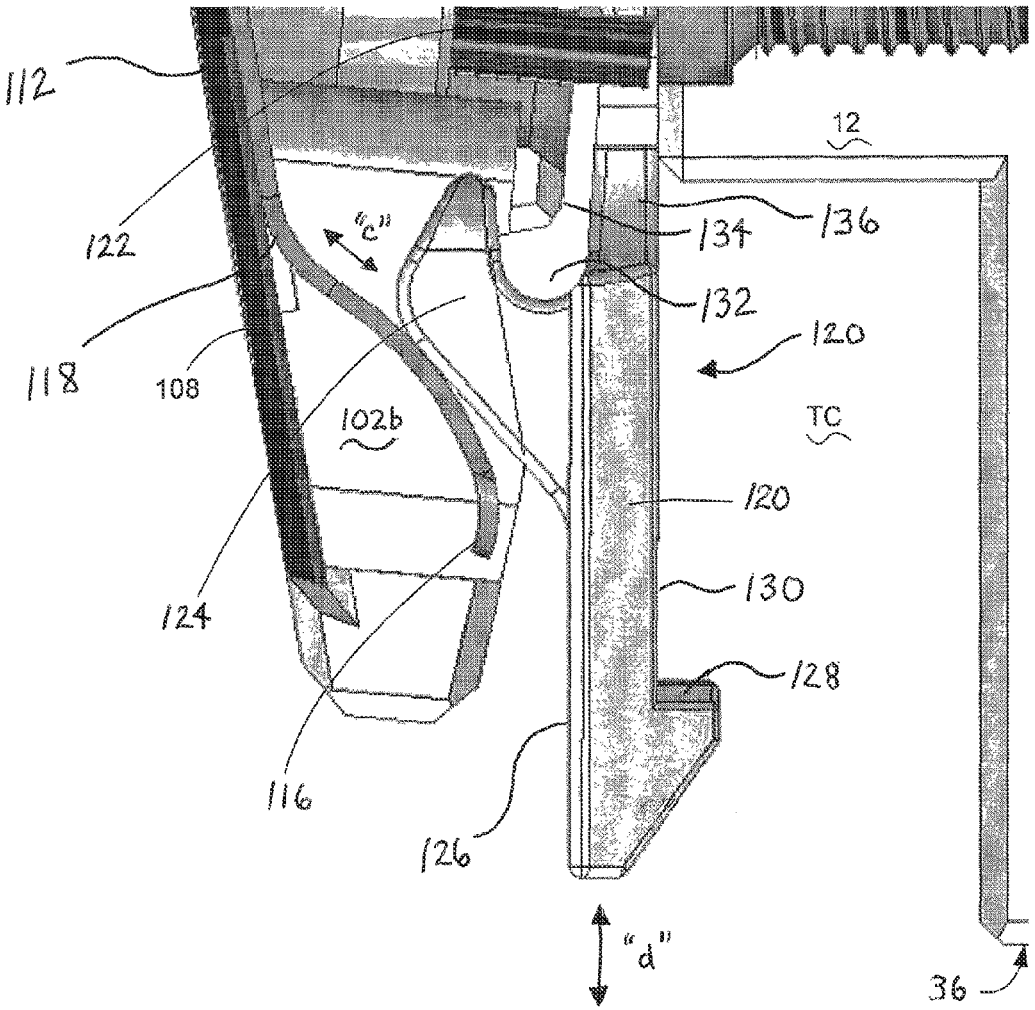
FIG. 17 is an enlarged detail view of portion C of FIG. 16.

In summary, and with continued reference to FIGS. 16 and 17, the legs 116 of the spring plate 110 and the fins 124 of the fingers 120 are both configured to extend into the apertures 102*b* of the clamp body 102 such that the legs 116 and fins 124 make contact within the apertures 102*b*. Particularly, the legs 116 of the spring plate 110 are configured to continuously exert a spring force on the fins 124 of the fingers 120. Consequently, the fingers 120 are resiliently biased to project outward from the inner face 106 of the clamp body 102, so as to form the tool channel TC along with the supporting body 12. At the same time, the fingers 120 can be deflected back toward the clamp body 102, given sufficient force on the fingers 120, such as from a tool shank being brought in contact with one or more such fingers 120, as will be further detailed below.

Figure 9:
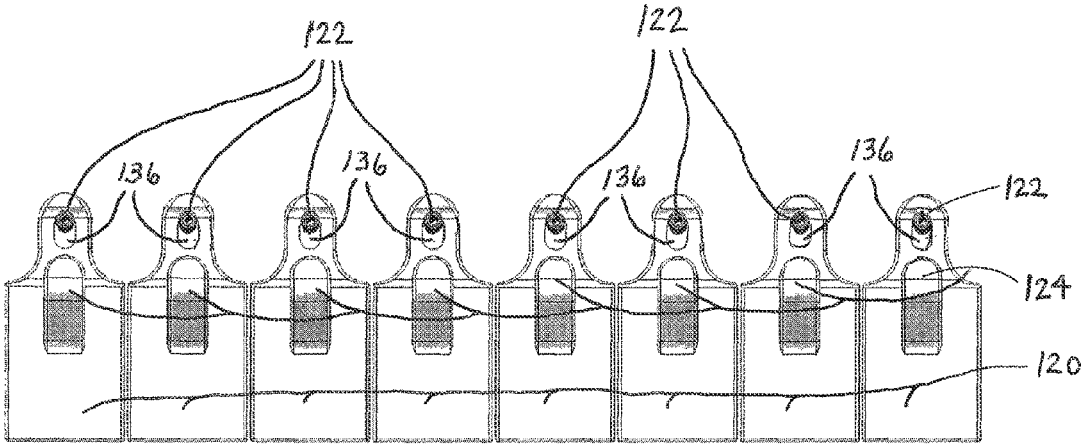
FIG. 9 is a front view of fingers and pins of the clamp of FIG. 7.
Figure 14:
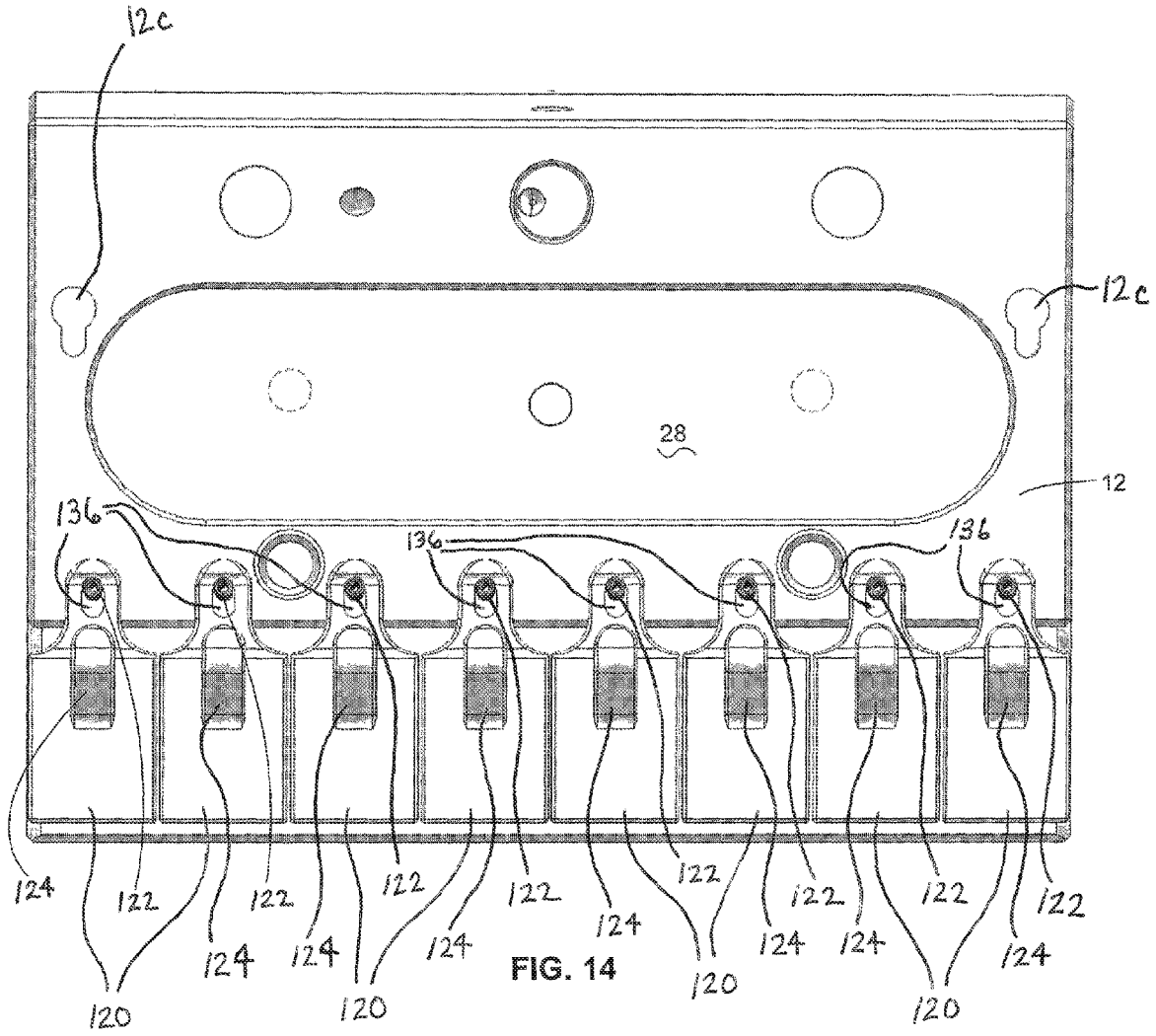

Continuing with FIGS. 7 and 8, and with further reference to FIGS. 9 and 16, while their fins 124 are adapted to extend into corresponding of the apertures 102*b* of the clamp body 102 and hook around shoulders 134 of such apertures 102*b*, support for the fingers 120 is derived via their connection to the pins 122. The pins 122, in certain embodiments, are cylindrically-shaped metal inserts. As shown in FIG. 16, in certain embodiments, each pin 122 protrudes from a bore 102*d* defined in the inner face 106 of the clamp body 102 and atop a corresponding one of the apertures 102*b* of the body 102. Continuing with reference to FIG. 16, the pins 122 extend from the clamp body 102, pass through the fingers 120, and contact the supporting body 12. To that end, in certain embodiments, the pins 122 are spring pins, so as to exhibit some flexibility while being normally biased toward the supporting body 12, thereby maintaining the position (and extension) of the pins 122 between the clamp bodies 102 and the supporting body 12. In certain embodiments, and with reference to FIGS. 9, 11, and 14 (with FIG. 14 showing a front view of the fingers 120 and the pins 122 as oriented relative to the supporting body 12), the pins 122 are configured to extend through slots 136 defined in each of the fingers 120. As perhaps most clearly shown in FIG. 16, based on the length of the slot 136 (along which the finger 120 can move vertically relative to the pin 122) and provision of corresponding gap 38 between clamp 100 and supporting body 12 (created by housing of piston 28), the fingers 120 are configured to move vertically (as is necessary) relative to the clamp body 102 and the supporting body 12. The significance of such freedom of vertical displacement for the fingers 120 will be further detailed herein. However, at this point, it should be understood that such freedom enables tools of varying sizes to be located and seated on the tool holder 10. Particularly, via such freedom of vertical displacement, the fingers 120 correspondingly adjust to differing notch distances to accommodate differing tool types.

As already described, the fingers 120 are configured to move toward and away from the clamp body 102 via continuous contact between the fins 124 of the fingers 120 and the legs 116 of the spring plate 110. This movement, in light of the fingers 120 being suspended via the pins 122, involves pivoting about the corresponding pins 122. Although, such pivoting necessitates an opposing force being applied to the fingers 120 which exceeds the biasing force that the spring plate 110 (via its legs 116) exerts on the fingers 120 (via its fins 124). For example, when a shank of a tool (e.g., tool 200) is loaded into or removed from the tool-mounting channel TC, the fingers 120 can be forced to pivot away (or outward) from the supporting body 12. However, the "sandwiching" of the spring plate 110 between the clamp body 102 and the cover plate 112 ensures that the legs 116 of the spring plate 110 recoil against the fingers 120 once the opposing force is removed. As such, after loading or removing a tool shank from the tool channel TC, the fingers 120 contacted by the shank are disposed to pivot toward (or inward relative to) the supporting body 12, and in so doing, retain the shank of the tool in the channel TC.

Figure 18:
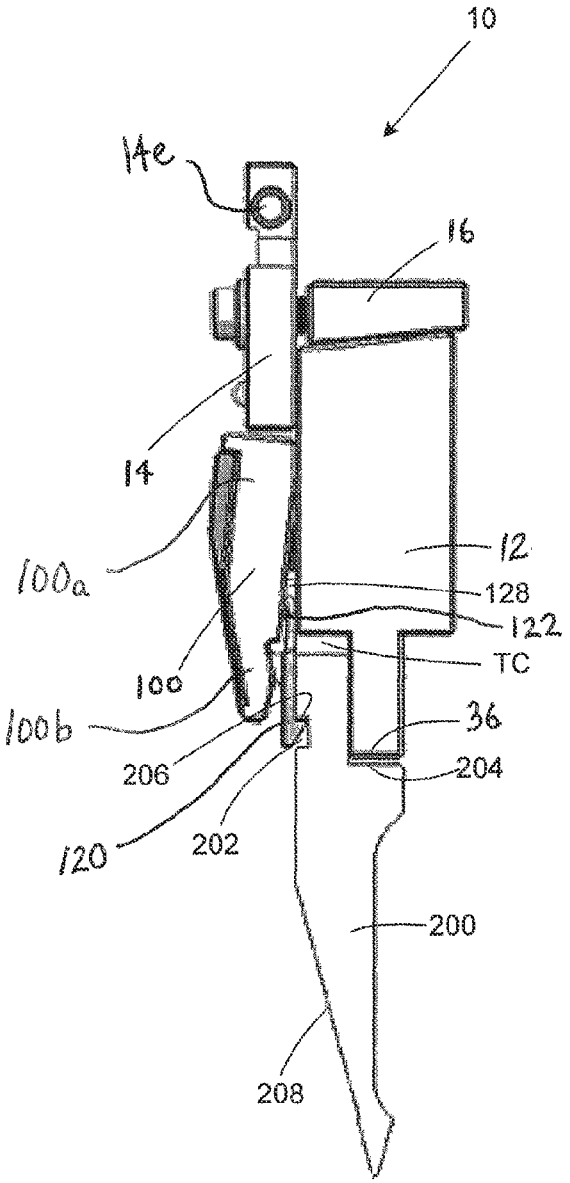
FIGS. 18 and 19 are side views showing the tool holder of FIG. 1 in differing settings with respect to a tool in accordance with embodiments of the invention.

Turning now to FIGS. 18 and 19, and with further reference to FIGS. 5, 16, and 17, locating and seating a tool (e.g., tool 200) within the tool holder 10 is detailed. FIG. 18 illustrates a tool 200 that has been located but not seated by the clamp 100, while FIG. 19 shows the tool 200 located and seated. Starting with the configuration shown by FIG. 18, and as has been already described above, when clamp-actuating system (e.g., pneumatic system) is deactivated (e.g., via switch 34), the clamp 100 is forced to pivot about the fasteners 18 and release a clamping force on any tool (if any) within the channel TC. Thus, in mounting tool 200 to tool holder 10, one starts with the clamp-actuated system in such deactivated state.

Given such deactivated state, a shank of a tool 200 can be inserted in the tool channel TC of the holder 10. As described above, force directed on the clamp fingers 120 by the tool shank correspondingly cause the fingers 120 to pivot outward (away from the supporting body 12), thereby widening the channel TC for insertion of the tool shank therein. However, when this force is removed, spring force from the spring plate 110 on the fingers 120 (via contact between legs 116 of plate 110 and fins 124 of the fingers 120) results in the fingers 120 recoiling back inward (toward the supporting body 12), narrowing the tool channel TC in the process. When the fingers 120 recoil inward (following insertion of the tool shank in the tool channel TC), the platforms 128 of the fingers 120 are configured to align with and enter the tool notch 202 of the tool 200. To that end, the fingers 120 subsequently support the tool 200 via contact between the platforms 128 of the fingers 120 and upper ledge 206 of the tool notch 202. Such initial engagement between the fingers 120 and tool 200 is shown in FIG. 18.

Following such initial engagement, the clamp-actuating system can be activated. As described above, activation of such system results in the clamp 100 pivoting about the fasteners 18 and applying a clamping force on the tool 200 within the tool channel TC. As shown in FIG. 19, and with reference to FIGS. 16 and 17, as a result of such pivoting of the clamp 100, the legs 116 of the spring plate 110 are correspondingly pivoted inward relative to the tool channel TC. As described above, the legs 116 of the spring plate 110 are in continuous contact with the fins 124 of the fingers 120 within the apertures **102*b* of the clamp body 102. As such, due to the inward pivoting of the spring plate legs 116, an enhanced spring force is exerted on the fins 124 of the fingers 120. However, because the tool shank is accommodated within the tool channel TC, whereby the outer faces 130 of the fingers 120 are in contact with the tool shank, such enhanced force on the fins 124 is redirected back on the fins 124, which causes the fins 124 to creep at an angle along the bend curvature of the spring plate legs 116 (along axis "c;" see FIGS. 16 and 17). Such creeping of the fins 124 along the legs 116 results in corresponding vertical movement of the fingers 120 relative to the pins 122 (along axis "d;" via the slots 136 defined in the fingers 120 and the gap 38 defined between the body 102 of the clamp 100 and the supporting body 12). Such vertical movement of the fingers 120 corresponds with a like vertical movement of the platforms 128 of the fingers 120. As described above, such platforms 128 are in contact with the upper ledge 206 of the tool notch 202. Accordingly, the fingers 120 shift vertically about the pins 122 (via the slots 136 of the fingers 120) until the load-receiving surface 204 of the tool 200 is seated against the load-delivering surface 36 of the tool holder 10 (wherein such surface 36 is of the supporting body 12**).

In order to remove and/or replace the tool 200, the clamp-actuating system is deactivated (e.g., via switch 34). As already described, this will result in the clamp 100 pivoting about the fasteners 18 (via action of the fasteners 31 and corresponding spring members 33) and release of the clamping force from the tool 200. However, the platforms 128 of the fingers 120 will continue to project into the tool channel TC, and thereby project in the notch 202 of the tool shank. Thus, even with deactivation of the clamp-actuating system, the fingers 120 retain the tool 200 via contact between the platforms 128 and upper ledge 206 of the tool 200. Thus, in removing the tool 200 from the tool holder 10, the tool 200 can be rotated, whereupon the corresponding force can repel the corresponding fingers 120 outward (away from the supporting body 12), thereby widening the tool channel TC until the tool shank can be pulled free from the channel TC. As described above, once the tool 200 is removed, spring force from the spring plate 110 on the fingers 120 (via contact between legs 116 of plate 110 and fins 124 of the fingers 120) results in the fingers 120 recoiling back inward (toward the supporting body 12), narrowing the tool channel TC in the process.

As described above, FIGS. 20 and 21 illustrate tools 200' and 200" having different notch distances (respectively shown as "a" and "b") and their relation to a finger 120 of the clamp 100. Given the above description concerning the use of the tool holder 10 in locating and seating a tool 200 thereon, it should be appreciated that the tool holder 10 is capable of accommodating differing tool types and sizes, e.g., having differing notch distances. Particularly, so long as the platforms 128 of the fingers 120 can be aligned with notches of the tool shanks, and the shanks of the tools can be accommodated by the tool channel TC such that the tool-receiving surfaces of the tools can be sufficiently raised therein so as to be seated against the tool-delivering surface 36 of the tool holder 10, the holder 10 is configured to locate and seat such tools. To that end, the capability by which the tools can be raised and seated within the tool channel TC of the tool holder 10 is generally dependent on the size of the slots 136 of the fingers 120 and size of gap 38 defined between the clamp body 102 and supporting body 12. In certain embodiments, the size of the slots 136 at least enables tools having standard tool notches of 12.5 mm and 13 mm to be accommodated by the tool holder 10. Although, the range of tools (and differing notch distances thereof) that can be accommodated by the holder 10 is selectively enhanced via corresponding increase of one or more of the following parameters: depth of the pockets 132 defined by the finger fins 124 (so as to permit greater vertical displacement of the shoulders 134 of the clamp body apertures **102*b*** within the pockets 132 and thereby greater vertical displacement of the fingers 120 relative to the clamp body 102), vertical extent of the finger slots 136 (so as to permit greater vertical displacement of the slots 136 relative to the pins 122 and thereby greater displacement of the fingers 120 relative to the pins 122), and depth of tool channel TC (so as to accommodate requisite vertical displacement of wide range of tool shank heights for seating purposes relative to the channel TC).

Figure 26:
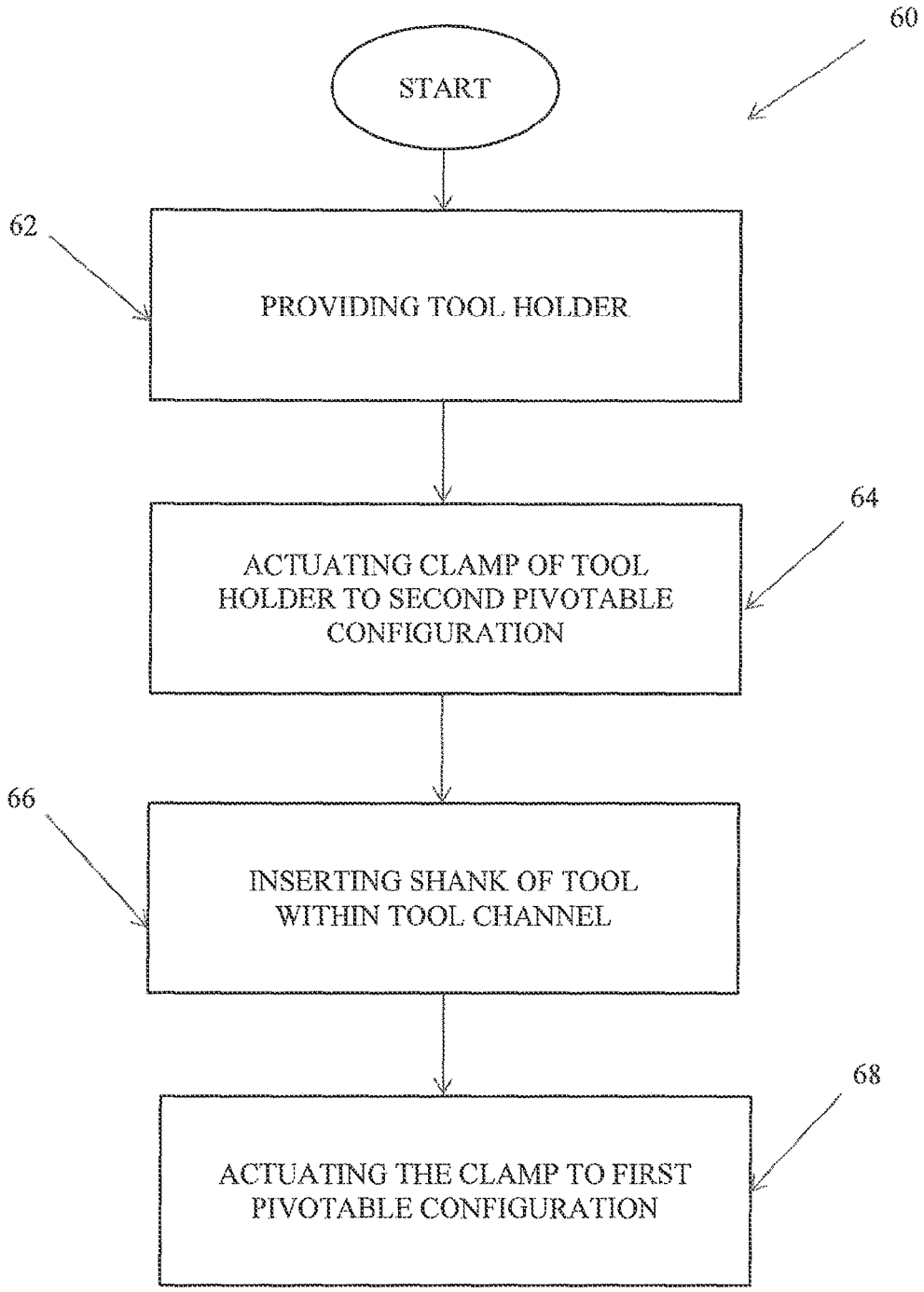
FIG. 26 is flowchart showing steps for locating and seating a tool on a tool holder in accordance with certain embodiments of the invention.

Given the above, and with reference back to above description for FIGS. 18 and 19, a method of locating and seating a tool 200 on a tool holder is described. Steps of such method are shown in flowchart 60 of FIG. 26 in accordance with certain embodiments of the invention. As shown, in step 62, an initial step involves providing the tool holder 10. To that end, the tool holder 10 includes the supporting body 12 and the clamp 100 operably coupled to the body 12. The supporting body 12 has load-delivering surface 36 that is substantially perpendicular to pressing axis PA of the tool holder 10. The clamp 100 and supporting body 12 define tool channel TC adapted to locate and seat any of a plurality of different tools (e.g., tool 200). The clamp 100 is selectively adjustable between first and second pivotable configurations relative to the supporting body 12, with corresponding impact on tool channel TC. Particularly, when the clamp 100 is in the first pivotable configuration, a clamping force is applied to the tool 200 positioned within the channel TC (as shown in FIG. 19), whereas when the clamp 100 is in the second pivotable configuration, the clamping force is removed from the tool 200 (as shown in FIG. 18).

Upon provision of the described holder 10, the clamp 100 is actuated (pivoted) to the second pivotable configuration in step 64. The clamp 100 includes fingers 120 that suspended by corresponding pins 122 extending between the clamp 100 and the supporting body 12, wherein the fingers 120 are biased inward toward the tool channel TC. However, when the clamp 100 is actuated to the second pivotable configuration, the fingers are deflectable outward from the tool channel to permit loading or removal of the tool 200 from the channel TC. Step 66 involves inserting a shank of the tool 200 within the channel TC, which correspondingly results in initial pivoting of one or more of the fingers 120 about the pins 122 and subsequent retention of the tool shank within the channel TC via corresponding engagement of the one or more fingers 120 with a notch 202 of the tool shank.

The clamp 100 is subsequently actuated (pivoted) to the first pivotable configuration in step 68. As a result, the fingers 120 are vertically displaced about the pins 122 such that a load-receiving surface 204 of the tool 200 is seated against the load-delivering surface 36 of the supporting body 12 via the engagement between the one or more fingers 120 and the tool notch 202. While not shown in the flowchart 60 of FIG. 26, the steps for removing the tool 200 from the tool holder 10 would involve further actuating the clamp to the second pivotable configuration (e.g., step 64), whereupon the tool 200 is removable from the tool holder 10 via rotation or pivoting of the tool 200, whereupon the corresponding force would repel the corresponding fingers 120 outward (away from the supporting body 12), thereby widening the tool channel TC until the tool shank can be pulled free from the channel TC. In addition, it should be appreciated that other steps, as further described with reference to FIGS. 18 and 19, can be added as desired to the steps 62-68 shown in FIG. 26.

Figure 22:
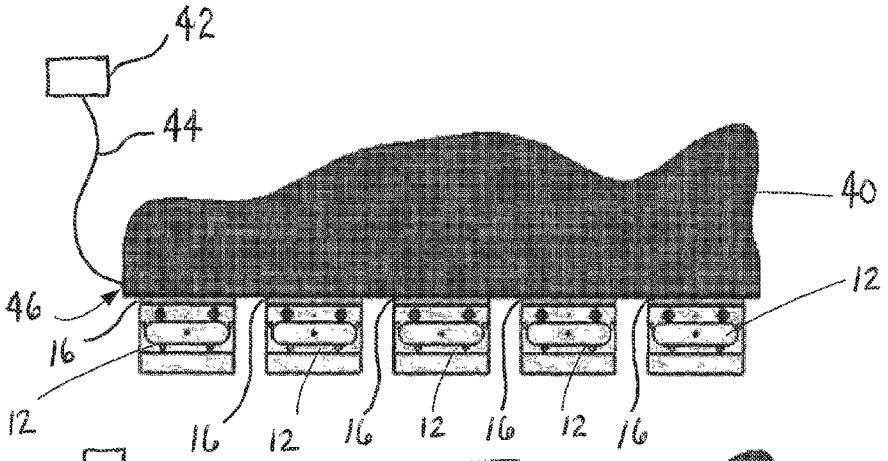
FIGS. 22-24 are front views of different tool holder arrangements on an upper beam of a press brake in accordance with certain embodiments of the invention.
Figure 23:
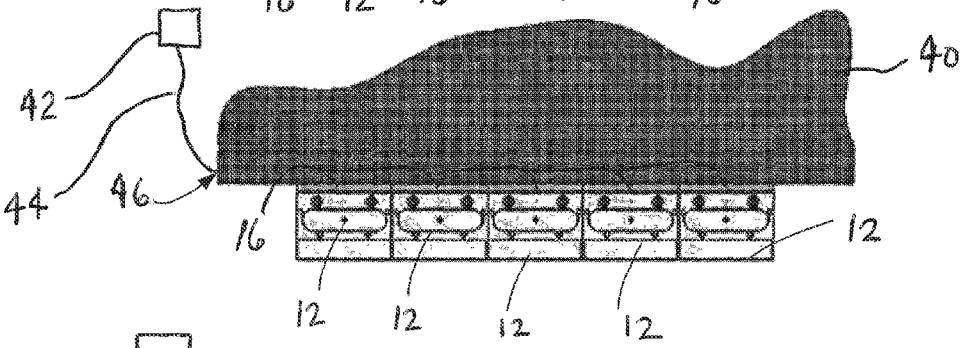
Figure 24:
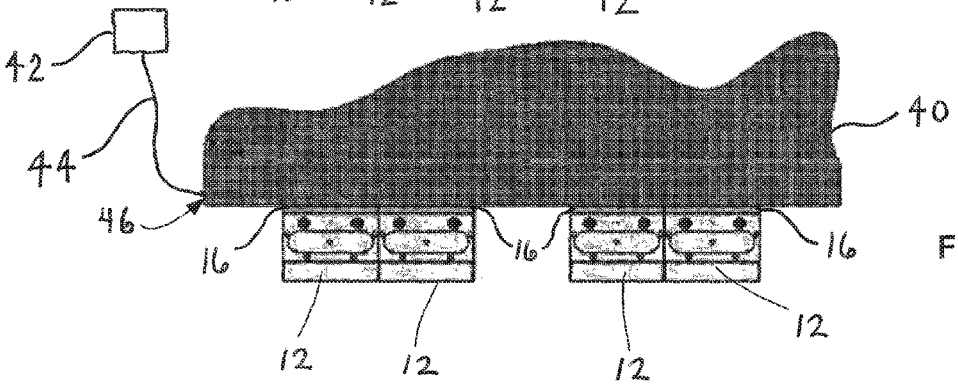

FIGS. 22-24 show different tool holder arrangements on an upper beam (or table) of a press brake in accordance with certain embodiments of the invention. As described above, in certain embodiments, a fluid power system (e.g., pneumatic, hydraulic, etc.) can be employed to selectively control pivoting of the clamp 100 of the tool holder 10, e.g., so as to apply or release clamping force on a tool within the tool channel TC of the holder 10. To that end, while only the supporting body 12 and wedge member 16 are shown being mounted to press brake upper beams 40 in FIGS. 22-24, this is done for simplicity. Particularly, where each supporting body 12/wedge member 16 is shown, the reader should understand that such is in reference to a tool holder 10 (with same view as shown in FIG. 3) being mounted to the beam 40 at such location. As described above, and with reference back to FIGS. 3 and 5, in actuating the fluid power system, e.g., a pneumatic system, air is driven within channels 26, 26' of the auxiliary block 14 and supporting body 12. In certain embodiments as shown in FIGS. 22-24, such airflow is provided via industrial air compressor 42 and corresponding hosing 44 (e.g., one or more hoses). As shown, in certain embodiments, the hosing 44 is operably joined to the upper table 40. In such case, the upper table 40 includes a coupling 46 to mate with hosing 44 and be in communication with a through-hole (not visibly) extending within a length of the press brake table to supply air to the tool holders 10 mounted thereon.

Turning back to FIG. 5, as described above, the auxiliary block 14 is defined with a channel 26 for distributing such flow of air to the switch 34, with the switch 34 (via its corresponding position) either permitting or halting such airflow with the channels 26' of the supporting body 12. In certain embodiments, with reference to FIG. 4, the channel 26 of the auxiliary block 14 can have an inlet **14*d* at an upper surface 11 of the block 14. Alternately, in certain embodiments, the auxiliary block 14 can be configured with a through-hole 14*e* in communication with the channel 26 of the block 14, thereby providing multiple inlets (e.g., top and side inlets) to be used with the channel 26. Depending on preferred choice of inlet for the auxiliary block 14**, connection (e.g., via air hose) can be made from through-hole of the press brake table to such inlet, while the other inlets (if any) can be capped.

Turning back to FIGS. 22-24, FIG. 22 shows a mounting configuration in which the tool holders 10 are each spaced apart, FIG. 23 shows a mounting configuration in which the tool holders 10 are each mounted as a group, in side-by-side fashion, and FIG. 24 shows a mounting configuration in which the tool holders 10 are mounted in a plurality of groups. Given these arrangements, if the tool holders 10 are grouped together or within a small spacing of each other, the through holes **14*e* of the auxiliary blocks 14 of the tool holders 10 can be serially connected (via hosing and/or mating couplings there between), such that when air or fluid is directed from the through-hole of the press brake 40 into the auxiliary block 14 (e.g., in the inlet 14*d* at its upper surface 11) of one of the holders 10, such flow further branches outward to each auxiliary block 14 of the other tool holders 10**.

Continuing with FIGS. 22-24, and with further reference to FIG. 3, it should generally be appreciated that the tool holders 12, whether grouped or spaced apart on a press brake beam, can be used to hold a single tool or multiple tools. Particularly, if grouped together, such tool holders 10 are often used to hold a single tool. To that end, if any of the tool holders 12 of FIGS. 22-24, respectively, are configured to hold a single tool (or be used collectively for doing so), in certain embodiments, the clamps 100 of such holders 10 are configured to be actuated simultaneously. As detailed above, in certain embodiments, each clamp 100 includes a manual switch 34 which can be used to toggle between at least two positions in which selected medium (e.g., air, fluid, etc.) is either supplied to, or halted from, flow within channels 26' of the supporting body 12. To that end, simultaneous actuation of the switches 34 on a plurality of grouped or spaced-apart holders 10 (e.g., via electrically-transmitted signal, as described below) allows for collective use of the holders 10. Alternately, use of a separate switch 34 with each of the spaced-apart tool holders 10 further allows for the clamps 100 of the holders 10 to be activated or released independent of each other, if desired.

Figure 25:
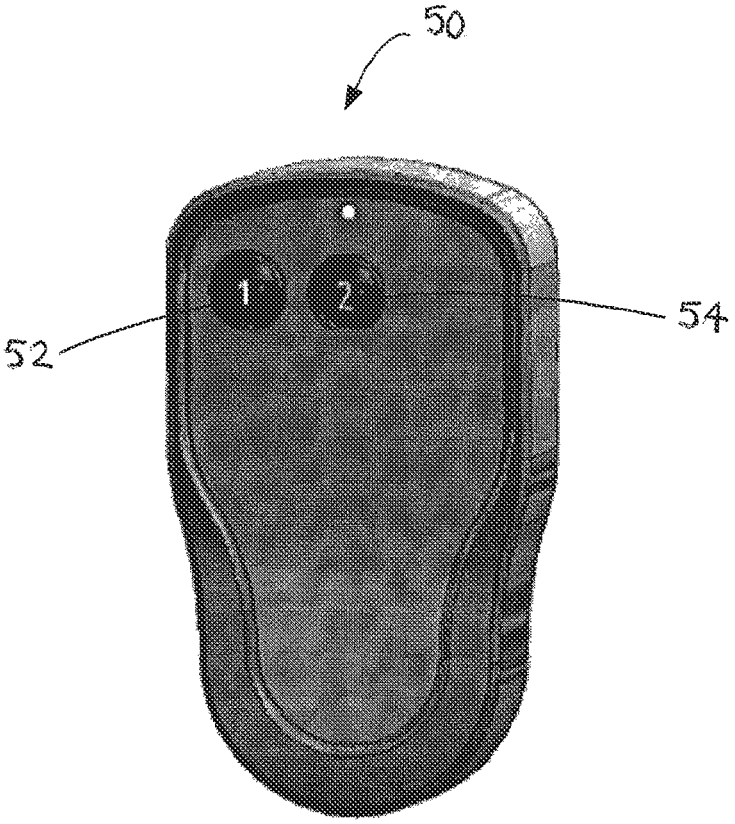
FIG. 25 is a front perspective view of a remote control for actuating the clamp of FIG. 7 of the tool holder of FIG. 1 in accordance with certain embodiments of the invention.

In certain embodiments, a further switch can be used alternately or in combination with one or more tool holders 10 (via their manual switches 34). For example, the further switch could be electrical, and activated by remote control 50 (exemplarily shown in FIG. 25), or an optical switch with visual cues from a 3D camera system. Other examples of such further switch may involve a hydraulic switch, a solenoid, or a piezo-electric element. For example, with further reference to FIG. 25, the remote control 50 can include a plurality of buttons 52, 54 for triggering the manual switches 34 of differing tool holders 10 or sets of holders 10. To that end, while the exemplary remote control 50 shows only two buttons 52 and 54, the invention should not be limited to such. Instead, the remote control 50 can be configured to have any plurality of buttons in order to simultaneously trigger any number of different combinations of manual switches 34 of tool holders 10. Alternately or in addition, in certain embodiments, such buttons can be provided on the remote control to trigger other activities. For example, such other buttons can be used for powering the press brake, for lowering or raising one or more press brake tables, starting/stopping a machining operation, etc.

Thus, embodiments of the invention are disclosed. Although the present invention has been described in considerable detail with reference to certain disclosed embodiments, the disclosed embodiments are presented for purposes of illustration and not limitation and other embodiments of the invention are possible. One skilled in the art will appreciate that various changes, adaptations, and modifications may be made without departing from the spirit of the invention.

What is claimed is:

1. A clamp for a tool holder, comprising:

a clamp body including a first face and a second face opposing the first face, the clamp body defined with a plurality of apertures spaced across a width of the clamp body, each aperture extending from the first face to the second face;

one or more spring plates operably coupled to the first face of the clamp body, each of the spring plates having a plurality of legs each correspondingly extending within one of the apertures;

a plurality of fingers suspended from the second face of the clamp body, the fingers each including a fin protruding from an inner side and including a platform projecting from an outer side at a first end, each fin correspondingly extending within one of the apertures and correspondingly contacting one of the legs of the one or more spring plates therein, each platform sized for engaging a notch or groove of a tool, the fingers defining a slot at a second end;

a plurality of pins each extending from the second face of the clamp body, the pins correspondingly situated adjacent to one of the apertures, the pins correspondingly extending within the slots of the fingers;

wherein the fingers are each correspondingly pivotable and vertically displaceable about the pins relative to the clamp body.

2. The clamp of claim 1 further comprising a cover plate operably coupled to the first face of the clamp body, wherein the one or more spring plates are held between the cover plate and the clamp body.

3. The clamp of claim 2 wherein the first face of the clamp body comprises a recess, wherein the one or more spring plates are situated within the recess and encapsulated between the cover plate and the clamp body.

4. The clamp of claim 1 wherein the apertures each define a shoulder adjacent to the second face of the clamp body, wherein the fins have shape curving back along extent of the fingers and thereby define corresponding pockets into which the shoulders of the apertures extend.

5. The clamp of claim 4 wherein extent of vertical displacement of the fingers is limited by vertical clearance of the shoulders within the pockets and vertical extent of the slots.

6. The clamp of claim 4 wherein the one or more spring plates exert biasing force on the fingers via said contact between the fins of the fingers and the legs of the spring plates, and wherein the fingers are resiliently biased to project outward from the second face of the clamp body, the fingers being configured to pivot about the pins and deflect one or more of the legs of the spring plates when force opposing and exceeding the biasing force is applied to the fingers.

7. The clamp of claim 6 wherein extent of pivoting of the fingers is limited by lateral clearance of the shoulders within the pockets.

8. A tool holder comprising the clamp of claim 1, wherein the tool holder further comprises:

a supporting body, the clamp operably coupled yet pivotable relative to the supporting body, wherein the clamp and supporting body collectively define a tool channel adapted to locate and seat any of a plurality of differing tools; and an auxiliary block operably coupled to the supporting body and configured to assist in pivoting of the clamp.

9. The tool holder of claim 8, further comprising a wedge member configured for mounting the tool holder to industrial machine or equipment, wherein the wedge member is operably coupled yet selectively movable to the auxiliary block and comprises a surface in contact with a surface of the supporting body, wherein movement of the wedge member with respect to the auxiliary block corresponds to variance in height of the member relative to the supporting body.

10. The tool holder of claim 9, wherein an upper surface of the wedge member is configured to be situated between the industrial machine or equipment and the supporting body, wherein the industrial machine or equipment comprise a table of a press brake.

11. The tool holder of claim 8, wherein the auxiliary block and supporting body are defined with channels which are linked to the clamp via intermediary means, wherein the intermediary means is activated via flow of medium within the channels, and wherein the activation of the intermediary means corresponds with pivoting of the clamp and corresponding application of clamping force on a tool loaded within the tool channel.

12. The tool holder of claim 11, wherein the medium comprises fluid or air, and wherein the intermediary means comprises a piston assembly situated between the supporting body and clamp.

13. The tool holder of claim 11, wherein contacting surfaces of the legs of the spring plate and the fins of the fingers are angled relative to each other, such that when a tool is loaded in the tool channel and the intermediary means is activated, pivoting of the clamp corresponds to an enhanced biasing force being exerted from the legs to the fingers, resulting in angled movement of the fins along the legs and corresponding vertical displacement of the fingers relative to the supporting body.

14. The tool holder of claim 13, wherein the vertical displacement of the fingers corresponds to vertical movement of the slots about the pins and vertical displacement of the platforms until a load-receiving surface of the loaded tool seats against a load-delivering surface of the supporting body.

15. The tool holder of claim 14, wherein the auxiliary block comprises a single pole switch situated between the channels of the auxiliary block and the channels of the supporting body, and wherein position of the switch corresponds to permitting or halting the flow of the medium between the channels of the auxiliary block and the channels of the supporting body.

16. The tool holder of claim 15, wherein positioning of the switch is controlled via controller remote from the tool holder, the controller communicating with the switch via transmitted signal.

17. A tool holder, comprising:

a supporting body having a load-delivering surface that is substantially perpendicular to a pressing axis of the tool holder; and a clamp being operably coupled to the supporting body, the clamp and supporting body defining a tool channel adapted to locate and seat any of a plurality of different tools, the clamp being selectively pivotable relative to the supporting body, a first pivotable configuration of the clamp corresponding to a clamping force being applied to a tool positioned within the channel and a second pivotable configuration of the clamp corresponding to a clamping force being released from a tool positioned within the tool channel;

wherein the clamp comprises one or more fingers adapted to engage tools inserted within the tool channel, the fingers correspondingly suspended by one or more pins extending between the clamp and the supporting body, the fingers being both pivotable and vertically displaceable about the pins, the fingers pivotable about the pins in the first pivotable configuration of the clamp for retaining a tool within the tool channel, and the fingers vertically displaceable about the pins in the second pivotable configuration of the clamp for seating a load-receiving surface of the tool against the load-delivering surface of the supporting body.

18. The tool holder of claim 17 wherein the clamp further comprises:

a clamp body including a first face and a second face opposing the first face, wherein the one or more fingers are suspended from the second face of the clamp body; and a spring plate operably coupled to the first face of the clamp body, wherein the spring plate extends within the clamp body so as to make continual contact with the fingers;

wherein the spring plate exerts biasing force on the fingers such that the fingers are resiliently biased to pivot about the pins toward the tool channel and engage a tool loaded in the tool channel, the fingers further configured to pivot about the pins and deflect the spring plate when force opposing and exceeding the biasing force is applied to the fingers for loading or removal of a tool in the tool channel.

19. The tool holder of claim 18 further comprising a cover plate operably coupled to the first face of the clamp body, wherein the spring plate is held between the cover plate and the clamp body.

20. The tool holder of claim 19 wherein the first face of the clamp body comprises a recess, wherein the cover plate is at least substantially received within the recess.

21. The tool holder of claim 20 wherein each of the clamp body and the cover plate have inward bends and thereby corresponding narrowed profiles relative to the pressing axis, wherein the bend clearance angle of the tool holder is no greater than 15 degrees.

22. The tool holder of claim 20, wherein the spring plate is situated within the recess and encapsulated between the cover plate and the clamp body, wherein such encapsulation enhances the rigidity of the spring plate, wherein the spring plate recoils against the one or more fingers upon removal of the opposing force.

23. The tool holder of claim 18 wherein the clamp body comprises one or more apertures extending from the first face to the second face, wherein the spring plate comprises one or more legs extending within corresponding of the apertures and the one or more fingers each comprise a fin extending within corresponding of the apertures, wherein said biasing force exerted on the fingers is via contact within the apertures between the one or more legs and the one or more fins.

24. The tool holder of claim 23, wherein contacting surfaces of the one or more legs of the spring plate and the one or more fins of the fingers are angled relative to each other, such that when a tool is loaded in the tool channel and the clamp is activated from the first pivotable configuration to the second pivotable configuration, an enhanced biasing force is exerted from the legs to the fingers resulting in angled movement of the fins along the legs and corresponding vertical displacement of the fingers relative to the supporting body.

25. The tool holder of claim 24, wherein each of the one or more fingers includes a platform, the platforms projecting from surface of the fingers opposite surface of the fingers from which the fins extend, the platforms configured for engaging with a notch or groove defined within a shank of a tool loaded in the tool channel, wherein the vertical displacement of the fingers corresponds to vertical displacement of the platforms until a load-receiving surface of the loaded tool seats against the load-delivering surface of the supporting body.

26. The tool holder of claim 25, wherein each of the fingers comprise a slot, the slot defined at an end of the fingers opposite end of the fingers from the platforms, the vertical displacement of the fingers corresponding to vertical movement of the slots about the pins.

27. The tool holder of claim 24, wherein pivoting of the clamp between the first pivotable and second pivotable configurations is triggered via a system integrated with the tool holder.

28. The tool holder of claim 27, wherein the system comprises channels extending through the tool holder and which are linked to the clamp via intermediary means.

29. The tool holder of claim 28, wherein the intermediary means is activated via flow of medium within the channels, and wherein activation of the intermediary means corresponds with pivoting of the clamp and corresponding application of clamping force on a tool loaded within the tool channel.

30. The tool holder of claim 29, wherein the medium comprises fluid or air, and wherein the intermediary means comprises a piston assembly situated between the supporting body and clamp.

31. The tool holder of claim 29, wherein the tool holder further comprises a switch situated between the channels of the tool holder, and wherein position of the switch corresponds to the flow of the medium either being permitted or being stopped within the channels of the tool holder.

32. The tool holder of claim 30, wherein positioning of the switch is controlled via controller remote from the tool holder, the controller communicating with the switch via transmitted signal.

33. A method of locating and seating a tool on a tool holder, the method comprising:

providing a tool holder, the tool holder comprising a supporting body and a clamp operably coupled to the supporting body, the supporting body having a load-delivering surface that is substantially perpendicular to a pressing axis of the tool holder, the clamp and supporting body defining a tool channel adapted to locate and seat any of a plurality of different tools, the clamp being selectively adjustable between first and second pivotable configurations relative to the supporting body;

actuating the clamp to the second pivotable configuration, the clamp comprising fingers that are suspended by corresponding pins extending between the clamp and the supporting body, the fingers being biased inward toward the tool channel, wherein when the clamp is actuated to the second pivotable configuration, the fingers are deflectable outward from the tool channel to permit loading or removal of a tool from the channel;

inserting a shank of a tool within the channel, resulting in initial pivoting of one or more of the fingers about the pins and subsequent retention of the tool shank within the channel via corresponding engagement of the one or more fingers with a notch of the tool shank; and actuating the clamp to the first pivotable configuration, whereby the fingers are vertically displaced about the pins such that a load-receiving surface of the tool is seated against the load-delivering surface of the supporting body via the engagement between the one or more fingers with the tool notch.

* * * * *